US006811094B2

(12) United States Patent
Kon et al.

(10) Patent No.: US 6,811,094 B2
(45) Date of Patent: Nov. 2, 2004

(54) ROTARY ATOMIZING HEAD TYPE COATER

(75) Inventors: Masatoshi Kon, Shizuoka (JP); Tetsuya Sonoda, Shizuoka (JP)

(73) Assignee: ABB K.K., Tokyo (JP)

( * ) Notice: Subject to any disclaimer, the term of this patent is extended or adjusted under 35 U.S.C. 154(b) by 177 days.

(21) Appl. No.: 10/203,630

(22) PCT Filed: Nov. 26, 2001

(86) PCT No.: PCT/JP01/10284

§ 371 (c)(1),
(2), (4) Date: Aug. 19, 2002

(87) PCT Pub. No.: WO02/051554

PCT Pub. Date: Jul. 4, 2002

(65) Prior Publication Data

US 2003/0010840 A1 Jan. 16, 2003

(30) Foreign Application Priority Data

Dec. 20, 2000 (JP) ..... 2000-387688

(51) Int. Cl.[7] ..... B05B 3/10; B05B 1/28; B44D 5/10; F23D 11/04

(52) U.S. Cl. ..... 239/223; 239/224; 239/296

(58) Field of Search ..... 239/223, 224, 239/296, 293, 298, 700–705, 104–106, 112, DIG. 14

(56) References Cited

U.S. PATENT DOCUMENTS 3,128,045 A * 4/1964 Gauthier ..... 239/703
5,353,995 A 10/1994 Chabert
5,397,063 A * 3/1995 Weinstein ..... 239/703
5,894,993 A * 4/1999 Takayama et al. ..... 239/112
6,050,499 A * 4/2000 Takayama et al. ..... 239/112
6,217,944 B1 * 4/2001 Yoshida et al. ..... 427/401
6,230,994 B1 * 5/2001 Boerner et al. ..... 239/700

OTHER PUBLICATIONS

Patent Abstracts of Japan, JP 11–28391, Feb. 2, 1999.

* cited by examiner

*Primary Examiner*—Michael Mar
*Assistant Examiner*—Darren Gorman
(74) *Attorney, Agent, or Firm*—Oblon, Spivak, McClelland, Maier & Neustadt, P.C.

(57) ABSTRACT

Segmental outward projections (12) are provided at radially opposite positions on the circumference of a tubular mount portion (7) of a main body (5), and truncated side portions (13) are provided between and at the opposite sides of the segmental outward projection (12). On the other hand, D-Shaped inward projections (14) are projected radially inward from a boundary portion between fore and rear inner peripheral surface portions (10B) and (10C) of a shaping air ring (10) in such a way as to define an outward projection passageway (15) conforming in shape with the segmental outward projections (12). At the time of mounting the rotary atomizing head (4) on the rotational shaft (3), the outward projections (12) are put in a conforming angular position relative to the outward projection passageway (15) to pass the inward projections (14). In the event the rotary atomizing head (4) is loosened and its position is shifted in a forward direction relative to the rotational shaft (3), the outward projections (12) are abutted against the inward projections (14) to prevent the rotary atomizing head (4) from falling off the rotational shaft (3).

9 Claims, 16 Drawing Sheets

ROTARY ATOMIZING HEAD TYPE COATER

TECHNICAL FIELD

This invention relates to a rotary atomizing head type coating machine which is suitable for use, for example, for coating vehicle bodies or the like.

BACKGROUND ART

Generally, rotary atomizing head type coating machines have been widely resorted to for coating vehicle bodies or similar work pieces. Shown by way of example in FIGS. 16 and 17 is a prior art rotary atomizing head type coating machine of this sort.

In these figures, indicated at 100 is a rotary atomizing head type coating machine as a whole. The rotary atomizing head type coating machine 100 is largely constituted by a machine cover 101 which is formed in a tubular shape, an air motor 102 which is accommodated in the cover machine 101, a rotational shaft 103 which is passed axially through the air motor 102 and rotationally driven by the latter, and a rotary atomizing head 104 which is mounted on the rotational shaft 103 on the front side of the machine cover 101 and thereby rotated at a high speed, for example, at a speed of 3,000 to 100,000 rpm to atomize and spray paint.

More specifically, as shown in FIG. 17, the rotational shaft 103 is provided with a male screw portion 103A around the circumference of a front end portion which is projected forward of the air motor 102. The rear side of the rotary atomizing head 104 is formed into a rotational shaft mount portion 104A of a tubular shape to receive therein a fore end portion of the rotational shaft 103. The rotational shaft mount portion 104A is provided with a female screw portion 104B on a deep inner peripheral portion for threaded engagement with the male screw portion 103A of the rotational shaft 103. The rotational shaft 103 and the rotary atomizing head 104 are integrally fixed to each other by tightly threading the male screw portion 103A into the female screw portion 104B.

A feed tube 105 is passed through the rotational shaft 103, and the fore end of the feed tube 105 is projected from the rotational shaft 103 and extended into the rotary atomizing head 104. A paint passage 105A and a thinner passage 105B are provided internally of the feed tube 105.

Further, an annular shaping air ring 106 is detachably attached to the front side of the machine cover 101, on the outer peripheral side of the rotary atomizing head 104. In order to control the spray pattern of paint which is sprayed by the rotary atomizing head 104, a large number of air outlet holes 106A are formed in this shaping air ring 106 at intervals in a circumferential direction for spurting shaping air toward sprayed paint particles.

In the case of the rotary atomizing head type coating machine 100 which is constructed in the manner as described above, while the rotary atomizing head 104 is put in high speed rotation by the air motor 102, paint is supplied to the rotary atomizing head 104 through the feed tube 105. Since the rotary atomizing head 104 is in high speed rotation, the supplied paint is atomized into fine particles under the influence of centrifugal force and sprayed forward. The spray pattern of paint particles is controlled by shaping air which is spurted from the shaping air ring 106 while paint particles are sprayed forward for deposition on a work piece.

By the way, according to the above-described prior art rotary atomizing head type coating machine 100, the rotational shaft 103 and the rotary atomizing head 104 are fixed to each other by threaded engagement of the male and female screw portions 103A and 104B. The screw threads of these screw portions 103A and 104B are tapped in the opposite direction with respect to the direction of rotation of the rotary atomizing head 103, more specifically, are tapped as right-turn screws in a case where the rotary atomizing head 103 is put in rotation in a counterclockwise direction as seen arrow a in FIG. 16 (turning leftward when seen from the front side of the rotary atomizing head 104). Therefore, when the rotational speed of the air motor 102 is on the increase, the rotational shaft 103 is tightened relative to the rotary atomizing head 104. On the other hand, when the rotational speed of the air motor 102 is on the decrease, the rotational shaft 103 is loosened relative to the atomizing head 104.

Nevertheless, should a trouble occur to a drive portion of the air motor 102 when it is in high speed rotation, the rotational speed of the air motor 102 could drop abruptly and the rotation itself could be totally stopped. Besides, for the purpose of changing the paint feed rate to the rotary atomizing head 104 or for the purpose of washing the rotary atomizing head 104 prior to a color change, there may often arise a necessity for dropping the rotational speed of the air motor 102 abruptly from about 30,000 rpm to about 10,000 rpm.

In such a case, despite an abrupt drop in rotational speed of the rotational shaft 103, the rotary atomizing head 104 tends to maintain a current rotational speed under the influence of inertial force, as a result acting to loosen the screw portions 103A and 104A, that is to say, to loosen the rotary atomizing head 104 relative to the rotational shaft 103. Therefore, while the air motor 102 is in high speed rotation, an abrupt drop of the air motor speed can lead to loosening and fall-off of the rotary atomizing head 104 from the rotational shaft 103.

Further, the rotary atomizing head 104 is subjected to large centrifugal force while in high speed rotation, and as a result the atomizing head mount portion 104A is spread in radially outward directions, lowering the gripping force of the male and female screw portions 103A and 104B of the rotational shaft 103 and the rotary atomizing head 104. Thus, upon a conspicuous drop in operating speed of the rotational shaft 103 or a sudden stop of the rotational shaft 103, the male and female screw portions 103A and 104B can be loosened until the rotary atomizing head 104 falls off the rotational shaft 103.

If the rotary atomizing head 104 should fall off the rotational shaft 103 during high speed rotation, it would be thrown away and hit against nearby equipments and work pieces, resulting in serious damages not only to the rotary atomizing head 104 itself but also to the nearby equipments and work pieces.

On the other hand, according to another prior art rotary atomizing head type coating machine, an O-ring is fitted on the outer periphery of a fore end portion of the rotational shaft or in the inner periphery of the rotary atomizing head mount portion to mount the rotary atomizing head on the rotational shaft through resilient force of the O-ring (e.g., as disclosed in Japanese Patent Laid-Open No. H11-28391).

However, in the case of the another prior art just mentioned, there is a problem of abrasive damages to the O-ring because the surface of the O-ring is abraded every time the rotary atomizing head is mounted on or dismantled from the rotational shaft. If an O-ring is used in a damaged state, it may no longer be able to stop the rotary atomizing head from falling off the rotational shaft because its force of fixing the rotary atomizing head to the rotational shaft is weakened considerably in the abrasive damage.

DISCLOSURE OF THE INVENTION

In view of the above-discussed problems with the prior art, it is an object of the present invention to provide a rotary atomizing head type coating machine which is, for the sake of higher reliability of operation and higher productivity, so arranged as to prevent a rotary atomizing head from coming off or from being thrown away from a rotational shaft when it is loosened relative to the latter while in operation.

The present invention is directed to a rotary atomizing head type coating machine of the sort which includes a high speed rotational drive source, a rotational shaft rotatably supported at a base end thereof by the rotational drive source and having a fore end portion projected on the front side of the rotational drive source, a rotary atomizing head having on the front side thereof a paint atomizing portion for atomizing supplied paint into finely divided particles and on the rear side a tubular mount portion to be mounted on a projected fore end portion of the rotational shaft, and a shaping air spurting means having an inner peripheral side thereof located in such a way as to circumvent outer periphery of the rotary atomizing head and adapted to spurt shaping air toward paint particles sprayed by the rotary atomizing head.

According to the present invention, for solving the above-discussed problems, there is provided a rotary atomizing head type coating machine which is characterized by the provision of: an outward projection provided on and projected radially outward from a circumferential surface of the tubular mount portion of the rotary atomizing head; and an inward projection provided on and projected radially inward from an inner peripheral surface of the shaping air spurting means and adapted to be brought into abutting engagement with the outward projection when the rotary atomizing head is loosened relative to the rotational shaft to prevent the rotary atomizing head from falling off the rotational shaft.

With the arrangements just described, in case the rotary atomizing head is loosened relative to the rotational shaft while in rotation and its position is shifted in axial direction, the outward projection which is projected radially outward from a circumferential surface of the tubular mount portion of the rotary atomizing head is abutted against the inward projection which is projected radially inward from an inner peripheral surface of a shaping air ring, thereby preventing the rotary atomizing head from falling off or from being thrown away from the rotational shaft in a completely freed state.

According to a preferred form of the present invention, the rotational shaft is provided with a male screw portion on a fore end portion thereof while the rotary atomizing head is provided with a female screw portion within the tubular mount portion for threaded engagement with the male screw portion, and the outward and inward projections are adapted to be brought into abutting engagement with each other when position of the rotary atomizing head is shifted in a forward direction relative to the rotational shaft as a result of loosening of a threaded joint of the male and female screw portions.

With the arrangements just described, when the threaded joint portion of the male and female screws is loosened, for example, by an abrupt drop in rotational speed of the rotational shaft and the position of the loosened rotary atomizing head is shifted in an axially forward direction relative to the rotational shaft, the outward projection is abutted against the inward projection thereby to prevent the rotary atomizing head from coming off the rotational shaft in a freed state.

According to another preferred form of the present invention, the outward projection is positioned axially on the rear side of the inward projection when the rotary atomizing head is mounted in position on a fore end portion of the rotational shaft.

According to still another preferred form of the present invention, the shaping air spurting means is provided with a fore inner peripheral surface portion for accommodating the paint atomizing portion and a rear inner peripheral surface portion for accommodating the tubular mount portion of the rotary atomizing head, and the inward projection is provided in a boundary inner peripheral surface between the fore and rear inner peripheral surface portions.

According to a further preferred form of the present invention, the outward projection is provided at a plural number of positions on the circumference of the tubular mount portion of the rotary atomizing head at intervals in rotational direction, and the inward projection is provided at a plural number of positions on the inner periphery of the shaping air ring at intervals in rotational direction correspondingly to the outward projection in such a way as to define therebetween an outward projection passageway which permits passage of the outward projections only when the latter are in a conforming angular position.

With the arrangements just described, at the time of mounting or dismantling the rotary atomizing head on or from the rotational shaft, the outward projections on the side of the rotary atomizing head are turned into a conforming angular position relative to the outward projection passageway between the inward projections on the side of the shaping air spurting means, and in this state the tubular mount portion of the rotary atomizing head is advanced straightforward into the shaping air spurting means, letting the outward projections pass adjacent inward projections on the side of the shaping air spurting means. After passing the inward projections in this way, the rotary atomizing head can be mounted on or dismantled from the rotational shaft.

On the other hand, while the rotational shaft and the rotary atomizing head are in rotation, the outward projections are also put in rotation. Therefore, in the event the rotary atomizing head is loosened relative to the rotational shaft while in rotation, it is almost impossible for the plural number of outward projections, which are also in rotation, to pass through the outward projection passageway. Instead, the outward projections are abutted against the inward projections to prevent the rotary atomizing head from coming or falling off the rotational shaft.

According to a further preferred form of the present invention, the outward projection is constituted by a plural number of segmental outward projections projected radially outward at radially opposite positions on the circumference of the tubular mount portion of the rotary atomizing head and having truncated side portions at opposite sides thereof, and the inward projection is constituted by a plural number of D-shaped inward projections provided at radially opposite positions on the inner periphery of the shaping air spurting means in such a way as to form therebetween an outward projection passageway which permits passage of the outward projections only when the latter are in a conforming angular position.

With the arrangements just described, at the time of mounting or dismantling the rotary atomizing head on or from the rotational shaft, the segmental outward projections on the side of the rotary atomizing head are turned into a conforming angular position relative to the outward projection passageway on the side of the shaping air spurting means, with the truncated sides of the segmental outward projections in parallel relation with inner ends of the D-shaped inward projections. In this state, the tubular mount portion of the rotary atomizing head is advanced straightforward into the shaping air spurting means, letting the segmental outward projections pass through the outward projection passageway. After passing the inward projections in this way, the rotary atomizing head can be mounted on or dismantled from the rotational shaft.

On the other hand, while the rotational shaft and the rotary atomizing head are in rotation, the segmental outward projections are also put in rotation. Therefore, in the event the rotary atomizing head is loosened relative to the rotational shaft while in rotation, it is almost impossible for the segmental outward projections, which are also in rotation, to pass through the outward projection passageway. Instead, the segmental outward projections are abutted against the D-shaped inward projections.

According to a further preferred form of the present invention, at least either the outward projection or the inward projections is provided at a plural number of positions which are shifted in axial and rotational directions.

With the arrangements just described, in case an outward projection at one position should pass an adjacent inward projection although it is extremely improbable, other outward and inward projections are abutted against each other to prevent the rotary atomizing head from coming off the rotational shaft in a double assured manner.

According to a further preferred form of the present invention, the shaping air spurting means is detachably attached on the side of the rotational shaft, the outward projection is constituted by an annular outward projection formed around the entire circumference of the tubular mount portion of the rotary atomizing head, and the inward projection on the side of the shaping air spurting means is formed in an inside diameter larger than an outside diameter of the paint atomizing portion of the rotary atomizing head, the shaping air spurting means being removable from the machine before mounting or dismantling the rotary atomizing head on or from the rotational shaft.

With the arrangements just described, at the time of assembling the rotary atomizing head, firstly the rotary atomizing head is mounted on the rotational shaft and then the shaping air spurting means is attached to the machine in such a way as to circumvent the outer periphery of the rotary atomizing head, letting the inward projection pass over and along the outer periphery of the rotary atomizing head. In the event the rotary atomizing head is loosened relative to the rotational shaft, the annular outward projection is abutted against the inward projection on the side of the shaping air spurting means thereby to prevent the rotary atomizing head from falling off or from being thrown away from the rotational shaft.

On the other hand, at the time of disassembling the rotary atomizing head, the shaping air spurting means can be removed by passing the inward projection over and along the outer periphery of the paint atomizing portion of the rotary atomizing head, before dismantling the rotary atomizing head from the rotational shaft.

According to the present invention, there is also provided a rotary atomizing head type coating machine of the sort as mentioned above, which is characterized by the provision of: an annular outward projection formed around and projected radially outward from entire circumference of the tubular mount portion of the rotary atomizing head; a stopper anchor hole formed into the shaping air spurting means across and inward of an inner peripheral surface of the latter; and a stopper member fitted in the stopper anchor hole and adapted to be brought into abutting engagement with the annular outward projection when the rotary atomizing head is loosened relative to the rotational shaft to prevent the rotary atomizing head from falling off the rotational shaft.

With the arrangements just described, at the time of mounting or dismantling the rotary atomizing head on or from the rotational shaft, the stopper member is removed from the stopper anchor hole in the shaping air spurting means. Upon removal of the stopper member, the rotary atomizing head can be mounted on or dismantled from the rotational shaft. After connecting the rotary atomizing head to the rotational shaft, the stopper member is fitted in the stopper anchor hole. When set in position, the stopper member which is passed radially inward of the inner periphery of the shaping air spurting means is partly projected to form an inward projection on the inner periphery of the shaping air spurting means. Therefore, when the rotary atomizing head is loosened relative to the rotational shaft, the annular outward projection on the side of the rotary atomizing head is brought into abutting engagement with the stopper member to prevent the rotary atomizing head from coming off or from being thrown away from the rotational shaft.

According to a further preferred form of the present invention, the stopper anchor hole is positioned axially on the front side of the annular outward projection when the rotary atomizing head is mounted in position on the rotational shaft.

Accordingly to the present invention, preferably a machine cover is provided on the machine in such a way as to circumvent outer periphery of the rotational drive source, and the shaping air spurting means is attached to a front end portion of the machine cover.

BEST MODE FOR CARRYING OUT THE INVENTION

Figure 1:
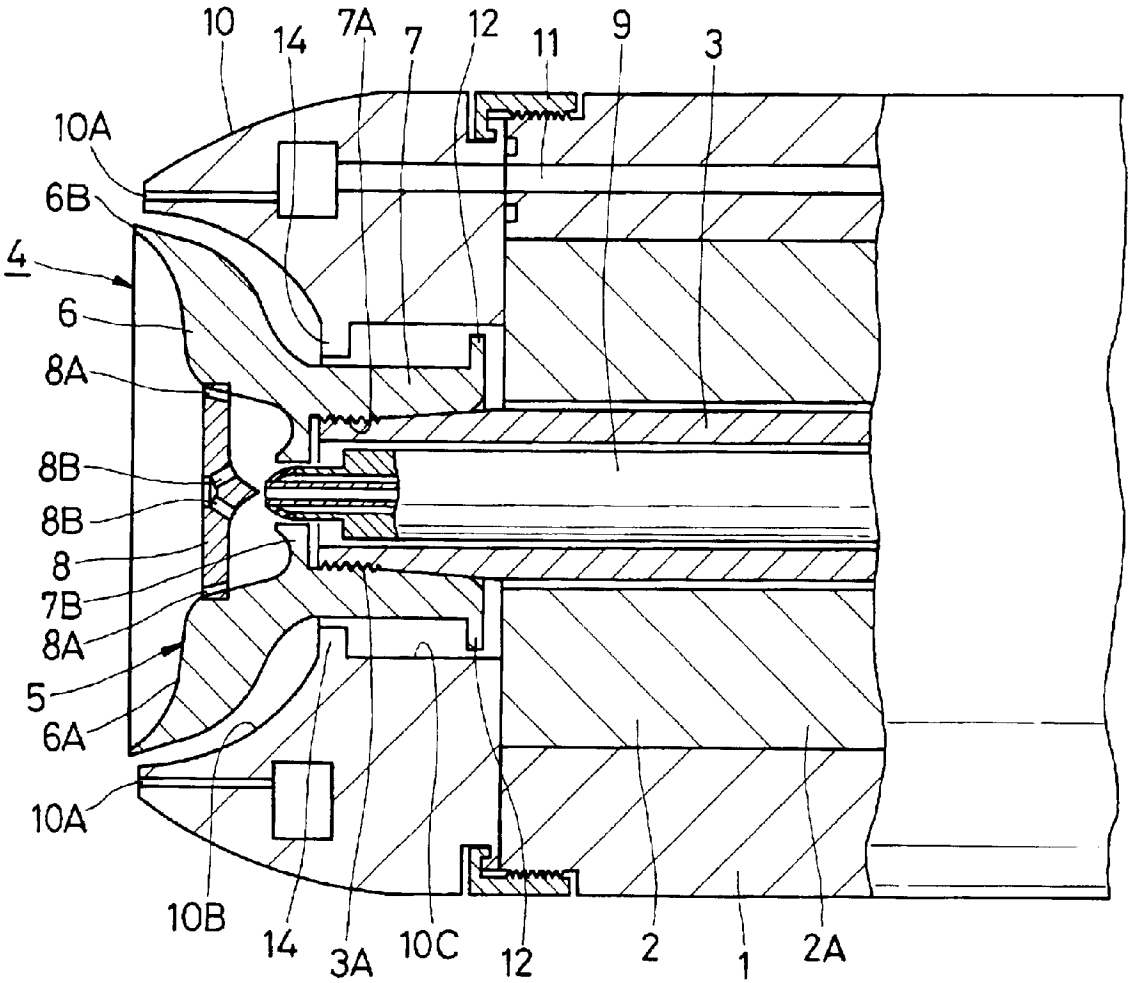
FIG. 1 is a fragmentary vertical sectional view of a rotary atomizing head type coating machine, adopted as a first embodiment of the present invention.

Hereafter, the rotary atomizing head type coating machine according to the present invention is described more particularly by way of its preferred embodiments with reference to the accompanying drawings.

Referring first to FIGS. 1 through 6, there is shown a first embodiment of the present invention. Indicated at 1 is a machine cover which covers the outer peripheral side of a rotary atomizing head type coating machine. The machine cover 1 is formed in a cylindrical shape to accommodate an air motor 2, which will be described below.

Indicated at 2 is the air motor which is housed in the machine cover 1 as a rotational drive source. The air motor 2 is largely constituted by a motor casing 2A which is formed in a tubular shape, an air turbine (not shown) which is accommodated in the motor casing 2A, and a static air bearing (not shown) for a rotational shaft 3, which will be described below. By compressed air which is supplied to the air turbine of the air motor 2, the rotational shaft is driven to rotate at a speed of 3,000 to 100,000 rpm.

Indicated at 3 is a hollow rotational shaft which is rotatably supported by the static air bearing of the air motor 2. Fore end of the rotational shaft 3 is projected on the front side of the air motor 2, and a male screw portion 3A is provided around the outer periphery of a projected fore end portion of the rotational shaft 3. On the other hand, a base end portion of the rotational shaft 3 is coupled with the air turbine of the air motor 2.

Indicated at 4 is a rotary atomizing head which mounted on a fore end portion of the rotational shaft 3. The rotary atomizing head 4 is constituted by a main body 5 and a hub member 8, which will be described after.

Figure 2:
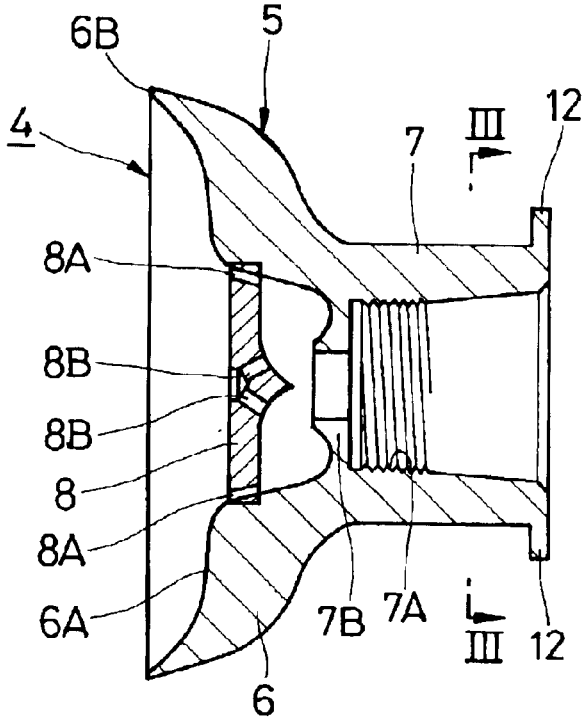
FIG. 2 is a vertical sectional view of a rotary atomizing head alone.
Figure 3:
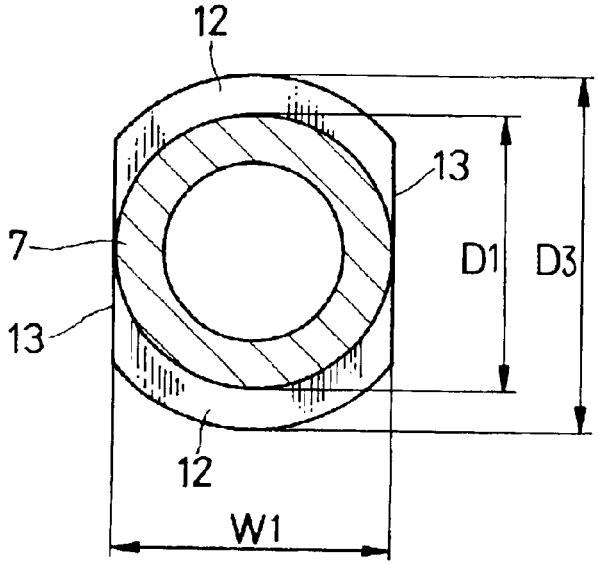
FIG. 3 is a cross-sectional view of a tubular mount portion of the rotary atomizing head, taken in the direction of arrows III—III in FIG. 2.

Denoted at 5 is a main body of the rotary atomizing head, which determines the outer configuration of the rotary atomizing head. The main body 5 is formed in a bell shape diverging from rear to front side thereof. As shown in FIGS. 2 and 3, the main body 5 is constituted by a paint atomizing portion 6 which is located on the front side and a tubular mount portion 7 which is located on the rear side.

Indicated at 6 is the paint atomizing portion which is provided on the front side of the main body 5 for atomizing supplied paint. The paint atomizing portion 6 is constituted by a paint spreading surface 6A which is provided on the front side of the main body 5 and diverged in the forward direction in the fashion of a round saucer, and paint releasing edges 6B which are provided at the fore end (of the inner periphery) of the main body 5 continuously from the paint spreading surface 6A. When the rotary atomizing head 4 is put in high speed rotation, paint which is supplied to the paint atomizing portion 6 is spread into a thin film along the paint spreading surface 6A and sprayed forward in the form of finely atomized particles from the paint releasing edges 6B.

Figure 5:
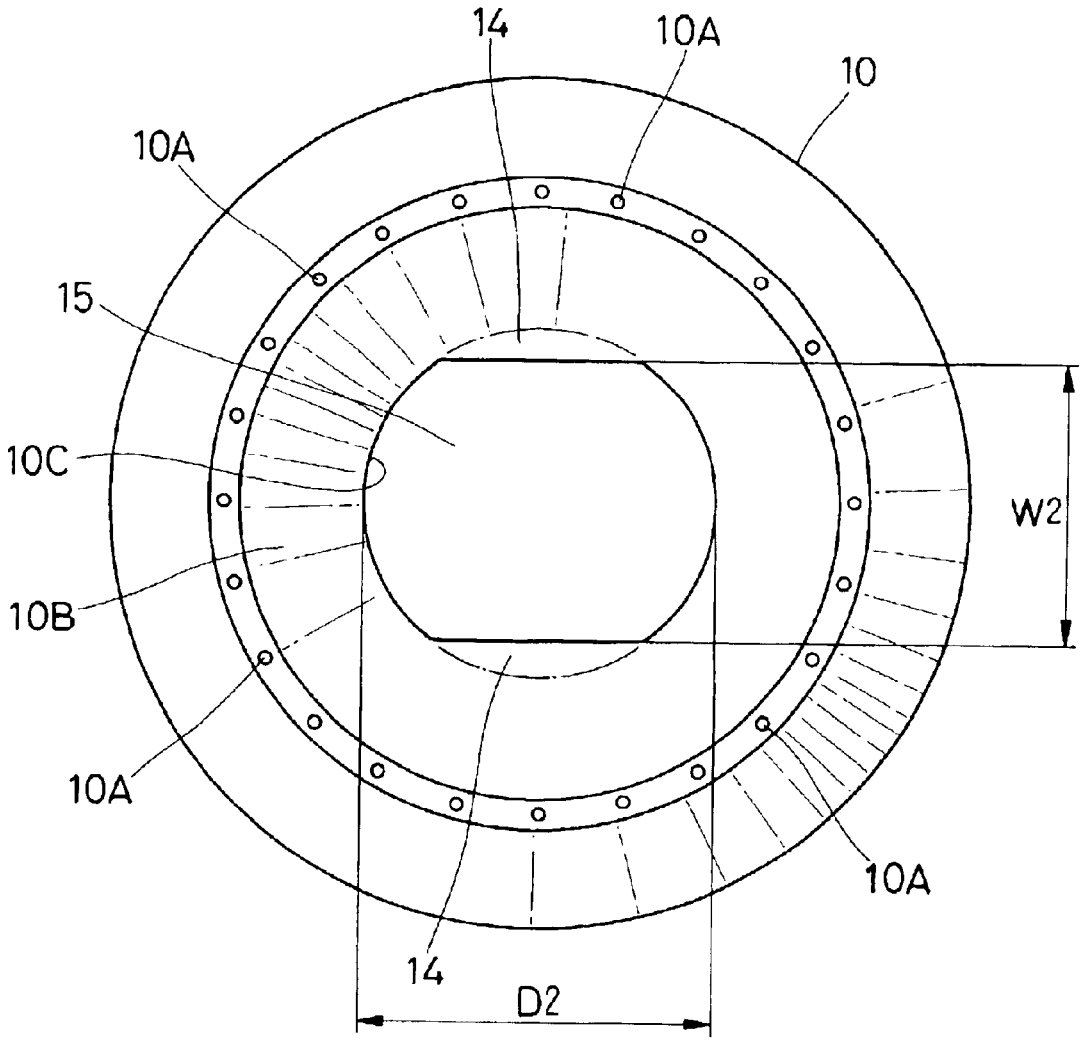
FIG. 5 is a front view of the shaping air ring, taken in the direction of arrows V—V in FIG. 4.

Designated at 7 is a blind-bottomed tubular mount portion which is provided on the rear side of the main body 5 of the rotary atomizing head. A female screw portion 7A for threaded engagement with the male screw portion 3A on the side of the rotational shaft 3 is provided on a deep inner peripheral portion of the mount portion 7. Further provided on the main body 5 of the rotary atomizing head is an annular partition wall 7B which is projected radially inward in such a way as to separate the tubular mount portion 7 and the paint atomizing portion 6 from each other. Passed into the inner periphery of the annular partition wall 7B is a fore end portion of a feed tube 9, which is projected from the fore end of the rotational shaft 3 as will be described hereinafter. In this instance, as shown in FIGS. 3 and 5, the tubular mount portion 7 is arranged to have an outside diameter D1 which is smaller than a width W2 of a space between of D-shape inward projections 14, which will be described hereinafter (D1<W2).

Indicated at 8 is a disc-like hub member which is provided on the paint atomizing portion 6 of the main body 5. The hub member 8 is provided with a large number of first hub holes 8A in outer peripheral portions for passing supplied paint or thinner toward the paint spreading surface 6A of the paint atomizing portion 6, along with a plural number of second hub holes 8B which are provided in central portions of the hub member 8 for supplying thinner to the front side of the hub member 8.

The rotary atomizing head 4, which is arranged in the manner as described above, is mounted on the rotational shaft 3 by inserting a fore end portion of the rotational shaft 3 into the tubular mount portion 7 of the main body 5 and threading the female screw portion 7A onto the male screw portion 3A of the rotational shaft 3. In this instance, as explained hereinbefore in connection with the prior art, the male screw portion 3A of the rotational shaft 3 as well as the female screw portion 7A of the rotary atomizing head 4 is tapped in an inverse direction with respect to the rotational of the rotational shaft 3, for example, as a right-turn screw in a case where the rotational shaft 3 is rotated in a leftward direction (counterclockwise) when seen from the front side. Therefore, the threaded engagement of the male and female screw portions 3A and 7A is tightened by rotation of the rotational shaft 3.

When the rotary atomizing head 4 is in high speed rotation, paint from the feed tube 9 is supplied onto the paint spreading surface 6A through the first hub holes 8A in the hub member 8. Paint is formed into a thin film on the paint spreading surface 6A and then sprayed in the form of finely atomized particles from the paint releasing edges 6B.

Indicated at 9 is a feed tube which is passed through the rotational shaft 3. As shown particularly in FIG. 1, a fore end portion of the feed tube 9 is projected out of the rotational shaft 3 and extended into the rotary atomizing head 4. A paint passage and a thinner passage are provided internally of the feed tube 9. Therefore, the feed tube 9 serves to supply paint as well as a wash fluid like thinner to the rotary atomizing head 4.

Figure 4:
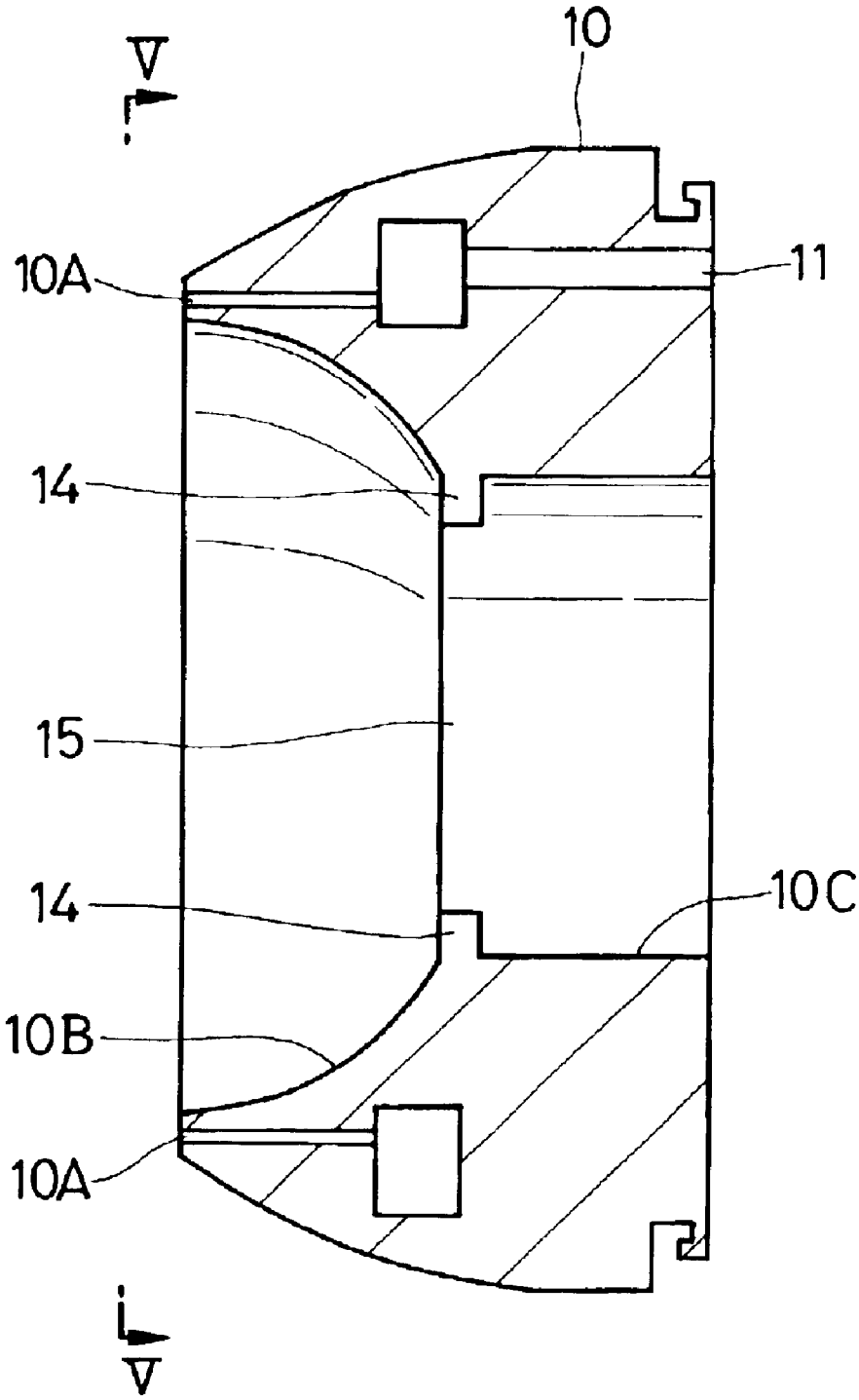
FIG. 4 is a vertical sectional view of a shaping air ring alone.

Indicated at 10 is a shaping air ring which is detachably provided in a front portion of the machine cover 1 as a shaping air spurting means, on the outer peripheral side of the rotary atomizing head 4. As shown in FIGS. 4 and 5 the shaping air ring 10 is formed generally in a tubular shape, and provided with a large number of air outlet holes 10A at intervals in the circumferential direction. Further, on the inner peripheral side, the shaping air ring 10 is provided with a front inner peripheral surface 10B which is diametrically diverged in the forward direction, and a rear inner peripheral surface 10C which is substantially uniform in diameter. Shaping air which is supplied through an air passage 11 which is extended axially from the machine cover 1 is spurted out through the respective air outlet holes 10A toward paint which is sprayed by the rotary atomizing head 4, thereby to control the spray pattern of the paint.

In this case, the front inner peripheral surface 10B of the shaping air ring 10, on the front side of D-shaped inner projections 14 which will be described hereinafter, is gradually diverged in the forward direction to accommodate the rotary atomizing head 4. The rear inner peripheral surface 10C on the rear side of the D-shaped inner projections 14 is arranged to have an inside diameter D2 which is larger than a diameter D3 between apex ends of segmental outward projection 12, which will be described hereinafter (D2>D3).

Indicated at 12 are a couple of segmental outward projections which are provided at the rear end of the tubular mount portion 7. In this instance, for example, the segmental outward projections 12 are formed by cutting off opposite sides of a collar or flange along two parallel lines tangent to the outer periphery of the tubular mount portion 7 with the outside diameter D1. As shown in FIG. 3, the segmental outward projections 12 are projected radially outward of the center axis of the tubular mount portion 7 at two symmetrically opposite positions on the outer periphery of the latter.

More specifically, in this instance, an outside diameter D3 between apex ends of the segmental outward projections 12 is set at a value which is larger than a width W2 of a space between D-shaped inner projections 14, which will be described hereinafter, but smaller than an inside diameter D2 of the rear inner peripheral surface 10C of the shaping air ring 10 (W2<D3<D2).

Further, indicated at 13 are truncated side portions which are provided on the opposite sides of the segmental outward projections 12 as a result of formation of the latter. These truncated side portions 13 are disposed substantially parallel with each other and tangential to the outer periphery of the tubular mount portion 7 of the main body 5. The width W1 between the two truncated side portions 13 is approximately same as the outside diameter Dl of the tubular mount portion 7 of the main body 5 (W1≈D1).

Indicated at 14 are a couple of D-shaped inward projections which are provided at the front end of the rear inner peripheral surface 10C (bordering on the fore inner peripheral surface 10B) of the shaping air ring 10. In this instance, as shown in FIG. 5, at symmetrically opposite positions on the rear inner peripheral surface 10C of the shaping air ring 10, the D-shaped inward projections 14 are formed in the fashion of letter "D" and substantially parallel with each other and projected radially inward toward the center axis of the shaping air ring 10. The width W2 of the space between the D-shaped inward projections 14 is set at a value which is slightly larger than the width W1 between the truncated side portions 13 (or the outside diameter D1 of the tubular mount portion 7) (W2>W1). Needless to say, when the rotary atomizing head 4 is mounted on the rotational shaft 3, the D-shaped inward projections 14 are positioned axially forward of the segmental outward projections 12.

Figure 6:
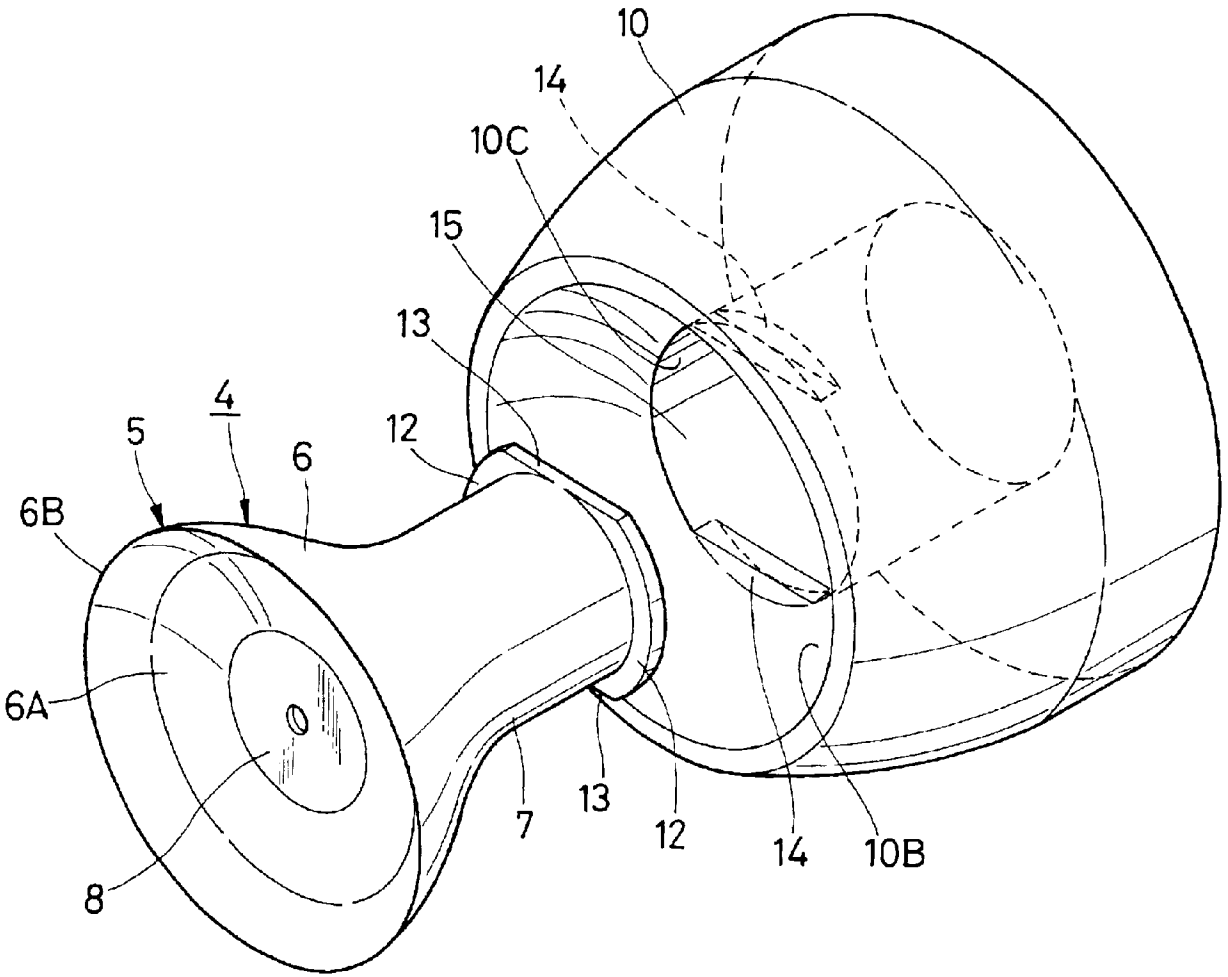
FIG. 6 is an exploded perspective view of the rotary atomizing head and the shaping air ring.

Indicated at 15 is an outward projection passageway which is provided between the D-shaped inward projections 14. As shown in FIGS. 5 and 6, the outward projection passageway 15 is formed as an oval space which permits passage of the tubular mount portion 7 and the two segmental outward projections 12. At the time of mounting or dismantling the rotary atomizing head 4 on or from the rotational shaft 3, the segmental outward projections 12 are positioned as shown in FIG. 6 relative to the passageway 15. It is only in this position that the segmental outward projections 12 of the rotary atomizing head 4 are allowed to pass through the passageway between the D-shaped inward projections 14 when the rotary atomizing head 4 is pushed in or pulled out straight forward or backward for mounting or dismantling same on or from the rotational shaft 3.

Namely, to summarize the above-discussed dimensional conditions, the outside diameter D1 of the tubular mount portion 7 of the main body 5, the inside diameter D2 of the inner peripheral surface 10C of the shaping air ring 10, the outside diameter D3 between the apex ends of the segmental outward projections 12, the width W1 between the truncated side portions 13, the width W2 of the space between the D-shaped inward projections 14 are in the following dimensional relations (1).

$$D1 \approx W1 < W2 < D3 < D2 \quad (1)$$

With the arrangements as described above, the segmental outward projections 12 and truncated side portions 13 on the side of the rotary atomizing head 4 and the D-shaped inward projections 14 and outward projection passageway 15 on the side of the shaping air ring 10 are so dimensioned as to permit passage of the segmental outward projections 12 through the outward projection passageway 15 at the time of mounting or dismantling the rotary atomizing head 4 on or from the rotational shaft 3, provided that the segmental outward projections 12 are put in a conforming angular position with the outer projection passageway 15. On the other hand, even if the rotary atomizing head 4 is loosened relative to the rotational shaft 3 and its position is shifted in a forward direction, there is no possibility of the segmental outward projections 12, which are also in rotation with the rotary atomizing head 4, being stopped in a conforming angular position relative to the outward projection passageway 15. On such an occasion, the segmental outward projections 12 are abutted against the D-shaped inward projections 14 by interference, thereby preventing the position of the rotary atomizing head 4 from being further shifted in a forward direction.

Described below are operations by the rotary atomizing head type coating machine according to the present embodiment, with the arrangements as described above.

Firstly, the rotary atomizing head 4 is mounted on the rotational shaft 3 in the following manner. At this time, the segmental outward projections 12 on the part of the rotary atomizing head 4 are turned into a conforming angular position relative to the outward projection passageway 15 on the part of the shaping air ring 10, followed by a rearward movement of the rotary atomizing head 4 toward the rotational shaft 3. In so doing, the segmental outward projections 12 are allowed to pass through the outward projection passageway 15 between the D-shaped inward projections 14 to bring the tubular mount portion 7 into the shaping air ring 10. In this state, the female screw portion 7A in the tubular mount portion 7 is threaded onto the male screw portion 3A of the rotational shaft 3 to set the rotary atomizing head 4 on the latter. The rotary atomizing head 4 can be dismantled from the rotational shaft 3 by inversely following the above-described mounting steps.

In the next place, in order to coat a vehicle body or other work piece by the use of the assembled coating machine, the air motor 2 is turned on to rotate the rotary atomizing head 4 along with the rotational shaft 3, for example, at a high speed approximately 30,000 rpm. After putting the rotary atomizing head 4 in high speed rotation along with the rotational shaft 3, paint is spurted toward the rotary atomizing head 4 from the fore end of the feed tube 9. At this time, under the influence of centrifugal force, the paint which has been supplied to the rotary atomizing head 4 is urged to flow onto the paint spreading surface 6A of the paint atomizing portion 6 through the first hub holes 8A of the hub member 8. The supplied paint on the paint spreading surface 6A is then sprayed in the form of finely atomized particles from the paint releasing edges 6B and deposited on a work piece. In the meantime, air is spurted out from the air outlet holes 10A of the shaping air ring 10 to control the spray pattern of the sprayed paint particles.

On the other hand, at the time of changing the paint color, the speed of the rotational shaft 3 is dropped, for example, from 30,000 rpm to about 10,000 rpm before supplying thinner to the rotary atomizing head 4 in place of paint. Upon supplying thinner to and through the first hub holes 8A of the hub member 8, deposited paint residues on the paint spreading surface 6A and paint releasing edges 6B of the paint atomizing portion 6 are washed away with thinner, and at the same time the front face of the hub member 8 is washed with thinner which flows out through the second hub holes 8B.

At the time of a washing operation, however, the operating speed of the rotational shaft 3 needs to be dropped from 30,000 rpm to about 10,000 rpm as mentioned above. Besides, in case a trouble occurs to a drive portion of the air motor 2 while it is in high speed rotation, despite an abrupt drop in rotational speed of the air motor 2 (the rotational shaft 3), the rotary atomizing head 4 tends to maintain a current speed under the influence of inertial force. This causes loosening to the threaded joint portions of the rotary atomizing head 4 and the rotational shaft 3, and as a result the position of the rotary atomizing head 4 which is in rotation is shifted in a forward direction.

At this time, the segmental outward projections 12 which are provided on the rotary atomizing head 4 are in rotation along with the rotary atomizing head 4, so that there is almost no possibility of the segmental outward projections 12 passing through the outward projection passageway 15. The segmental outward projections 12 are abutted against the D-shaped inward projections 14 to restrict a further forward shift of the rotary atomizing head 4 and to prevent the latter from falling off the rotational shaft 3.

Besides, when the rotary atomizing head 4 is loosened relative to the rotational shaft 3, the rotational axis of the rotary atomizing head 4 is deviated from that of the rotational shaft 3. Therefore, the rotation of the rotary atomizing head 4 becomes eccentric relative to the rotational shaft 3 and the shaping air ring 10. In such a case, the position of the segmental outward projections 12 deviated in a radial direction relative to the outward projection passageway 15, making it more difficult for the segmental outward projections 12 to take a conforming angular position with the outward projection passageway 15. That is to say, fall-off of the rotary atomizing head 4 can be prevented more securely.

As described above, according to the present embodiment of the invention, at the time of mounting the rotary atomizing head 4 on the rotational shaft 3, the segmental outward projections 12 are turned into a conforming angular position with respect to the outward projection passageway 15, with the truncated sides 13 positioned substantially parallel with the inner ends of the D-shaped inward projections 14. In this position, the segmental outward projections 12 can be passed through the outward projection passageway 15 without being blocked by the D-shaped inward projections 14. On the other hand, in case the rotary atomizing head 4 is loosened relative to the rotational shaft 3 and its position is shifted in a forward direction, the segmental outward projections 12 are abutted against the D-shaped inward projections 14 thereby to prevent the rotary atomizing head 4 from falling off in a completely loose state. Accordingly, the rotary atomizing head 4 can be mounted and dismantled on and from the rotational shaft 3. During coating and washing operations, however, fall-off or flying of the rotary atomizing head 4 in a free state is securely prevented by the segmental outward projections 12 and the D-shaped inward projections 14 to ensure higher reliability and productivity of the machine.

Figure 7:
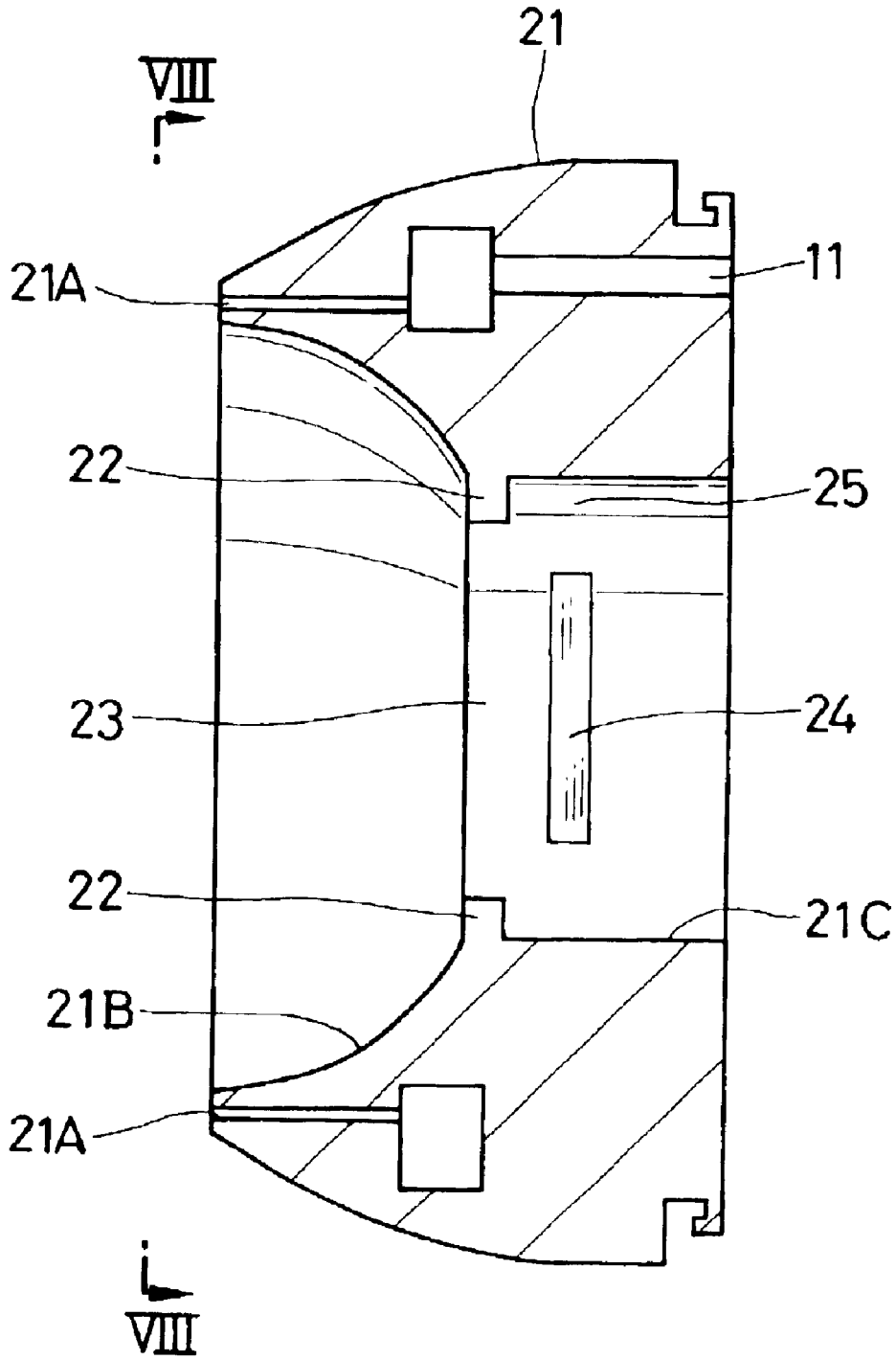
FIG. 7 is a vertical sectional view of a shaping air ring alone, according to a second embodiment of the present invention.
Figure 8:
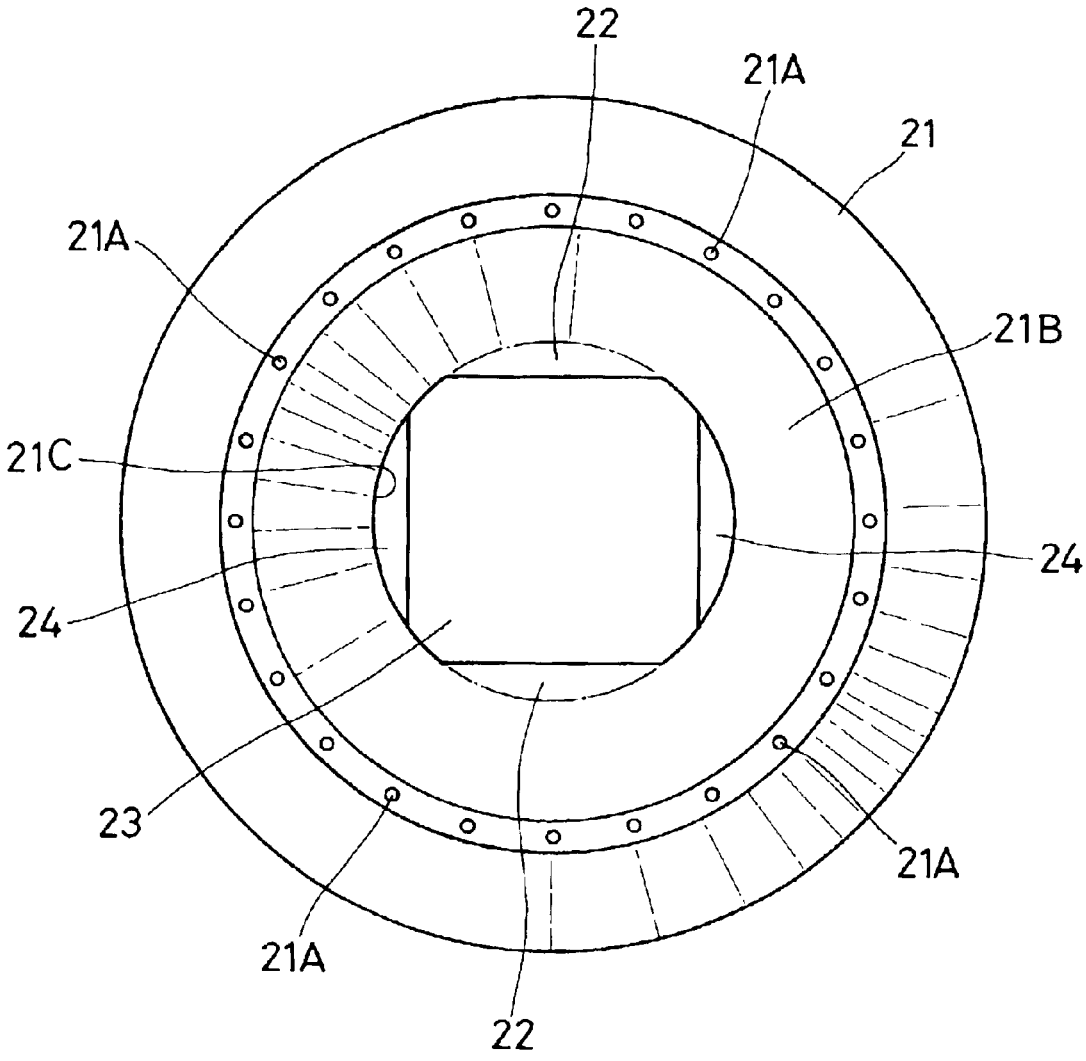
FIG. 8 is a front view of the shaping air ring, taken in the direction of arrows VIII—VIII in FIG. 7.
Figure 9:
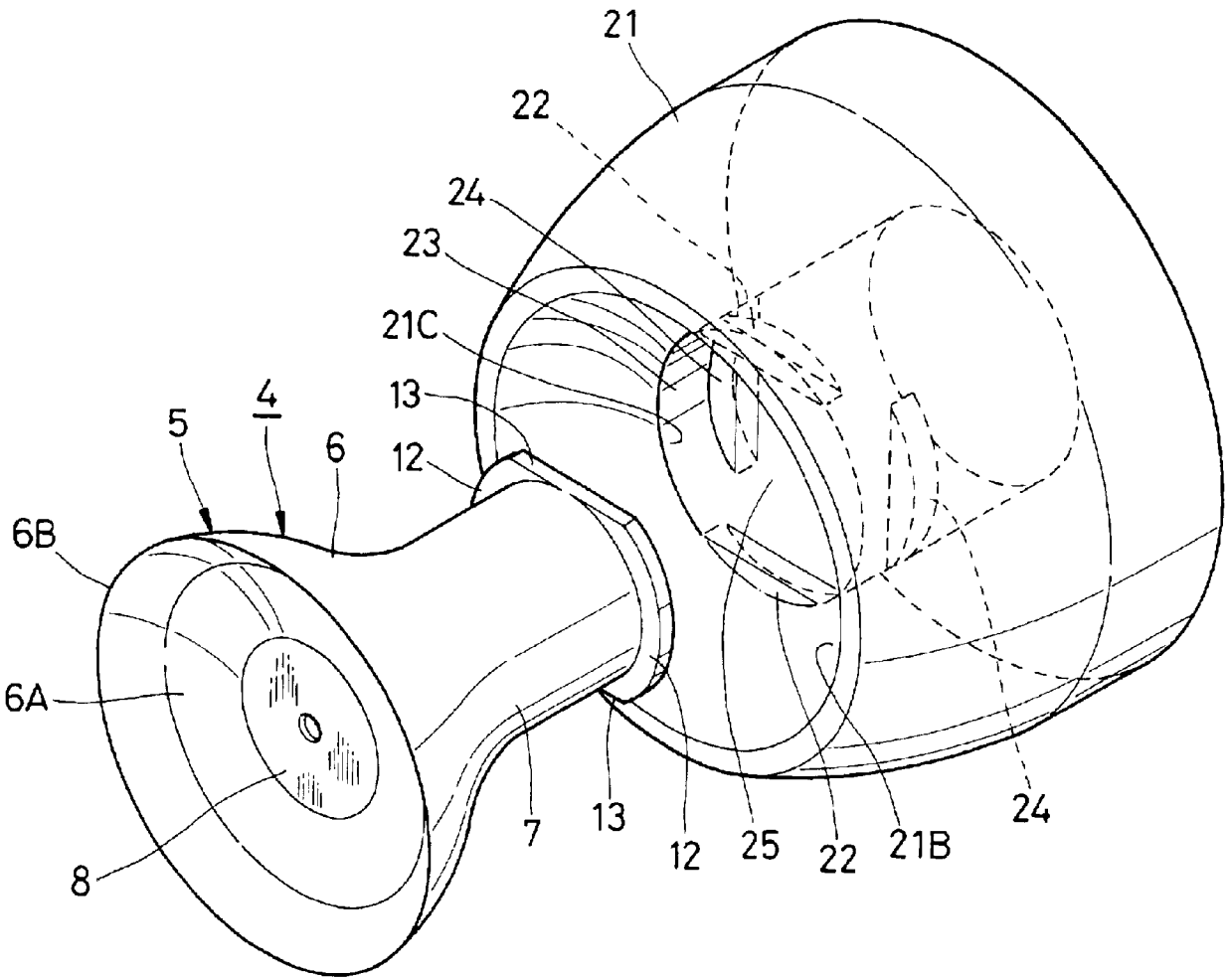
FIG. 9 is an exploded perspective view of the rotary atomizing head and the shaping air ring.

Now, referring to FIGS. 7 to 9, there is shown a second embodiment of the present invention. This embodiment has features in that D-shaped inward projections are provided at a plural number of positions which are shifted in the axial and circumferential or rotational directions of the shaping air ring. In the following description of the second embodiment, the construction of the rotary atomizing head 4 is same as in the foregoing first embodiment, and those component parts which are same as in the first embodiment are simply designated by the same reference numerals instead of repeating same explanations.

Indicated at 21 is a shaping air ring according to the present embodiment. As shown in FIGS. 7 and 8, the shaping air ring 21 is formed in a tubular shape, and provided with a large number of air outlet holes 21A on its front side and at intervals in the circumferential direction similarly to the foregoing first embodiment. However, the shaping air ring 21 of this particular embodiment differs from the shaping air ring 10 of the first embodiment in that it is provided with first D-shaped inward projections 22, first outward projection passageway 23, second D-shaped inward projections 24 and second outward projection passageway 25 in boundary regions between its front and rear inner peripheral surfaces 21B and 21C, in the manner as will be described in greater detail hereinafter.

Indicated at 22 are a couple of D-shaped inward projections which are provided at the front end of the rear inner peripheral surface 21C of the shaping air ring 21. Similarly to the D-shaped inward projections 14 in the first embodiment, these D-shaped inward projections 22 are projected radially inward toward the center axis of the shaping air ring and substantially in parallel relation with each other, at symmetrically opposite positions on the rear inner peripheral surface 21C.

Indicated at 23 is a first outward projection passageway which is provided between the first D-shaped inward projections 22. As shown in FIGS. 8 and 9, the first outward projection passageway 23 is formed in an oval shape to permit passage of the tubular mount portion 7 and the segmental outward projections 12, similarly to the outward projection passageway 15 in the first embodiment.

Now, indicated at 24 are a couple of second D-shaped inward projections which are provided on the rear inner peripheral surface 21C at positions on the rear side of the above-described first D-shaped inward projections 22, respectively. Similarly to the D-shaped inward projections 14 in the first embodiment, the second D-shaped inward projections 24 are projected radially inward toward the center axis of the shaping air ring and substantially in parallel relation with each other, at symmetrically opposite positions on the rear inner peripheral surface 21C. However, in this case, the second D-shaped inward projections 24 are located behind the first D-shaped inward projections 22 with a phase shift of 90 degrees from the latter.

Further, indicated at 25 is a second outward projection passageway which is provided between the second D-shaped inward projections 24. As shown in FIG. 9, the second outward projection passageway 25 is formed in an oval shape to permit passage of the tubular mount portion 7 and the segmental outward projections 12, similarly to the outward projection passageway 15 in the first embodiment. However, in this case, the second outward projection passageway 25 is located behind the first outward projection passageway 23 with a phase shift of 90 degrees from the latter.

Thus, according to the present embodiment with the arrangements as described above, at the time of mounting the rotary atomizing head 4 on the rotational shaft 3 as shown in FIG. 9, the segmental outward projections 12 are firstly put in a confirming position relative to the first outward projection passageway 23 and moved axially straight forward to pass through the first outward projection passageway 23 between the first D-shaped inward projections 22. In the next place, the rotary atomizing head 4 (the segmental outward projections 12) is turned through 90 degrees about its axis to take a conforming angular position relative to the second outward projection passageway 25. In this state, the segmental outward projections 12 are moved axially straight forward to pass through the second outward projection passageway 25 between the second D-shaped inward projections 24. Then the rotary atomizing head 4 is mounted on the rotational shaft 3. The rotary atomizing head 4 can be dismantled from the rotational shaft 3 by inversely following the above-described mounting steps.

On the other hand, in case the rotary atomizing head 4 is loosened while in rotation and its position is shifted in a forward direction, the segmental outward projections 12 are firstly abutted against the second D-shaped inward projections 24 and remain in this position to prevent fall-off of the rotary atomizing head 4. Besides, although very improbable, in case the segmental outward projections 12 happen to pass through the second outward projection passageway 25 (between the second D-shaped inward projections 24), the respective segmental outward projections 12 are abutted against the first D-shaped inward projections 22 to prevent fall-off of the rotary atomizing head 4 in a double assured manner, enhancing the reliability of the machine all the more.

Figure 10:
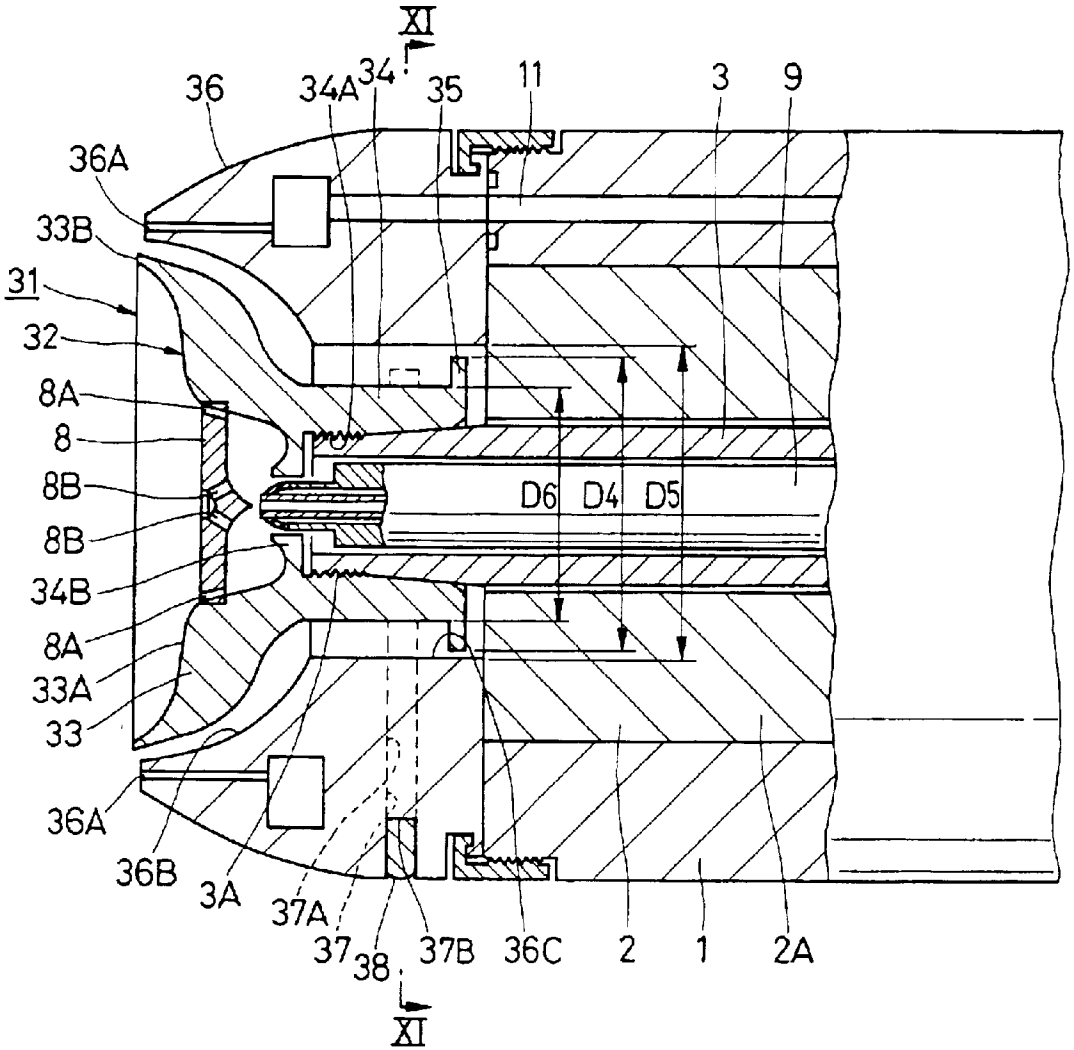
FIG. 10 is a fragmentary vertical sectional view of a rotary atomizing head type coating machine, adopted as a third embodiment of the present invention.
Figure 11:
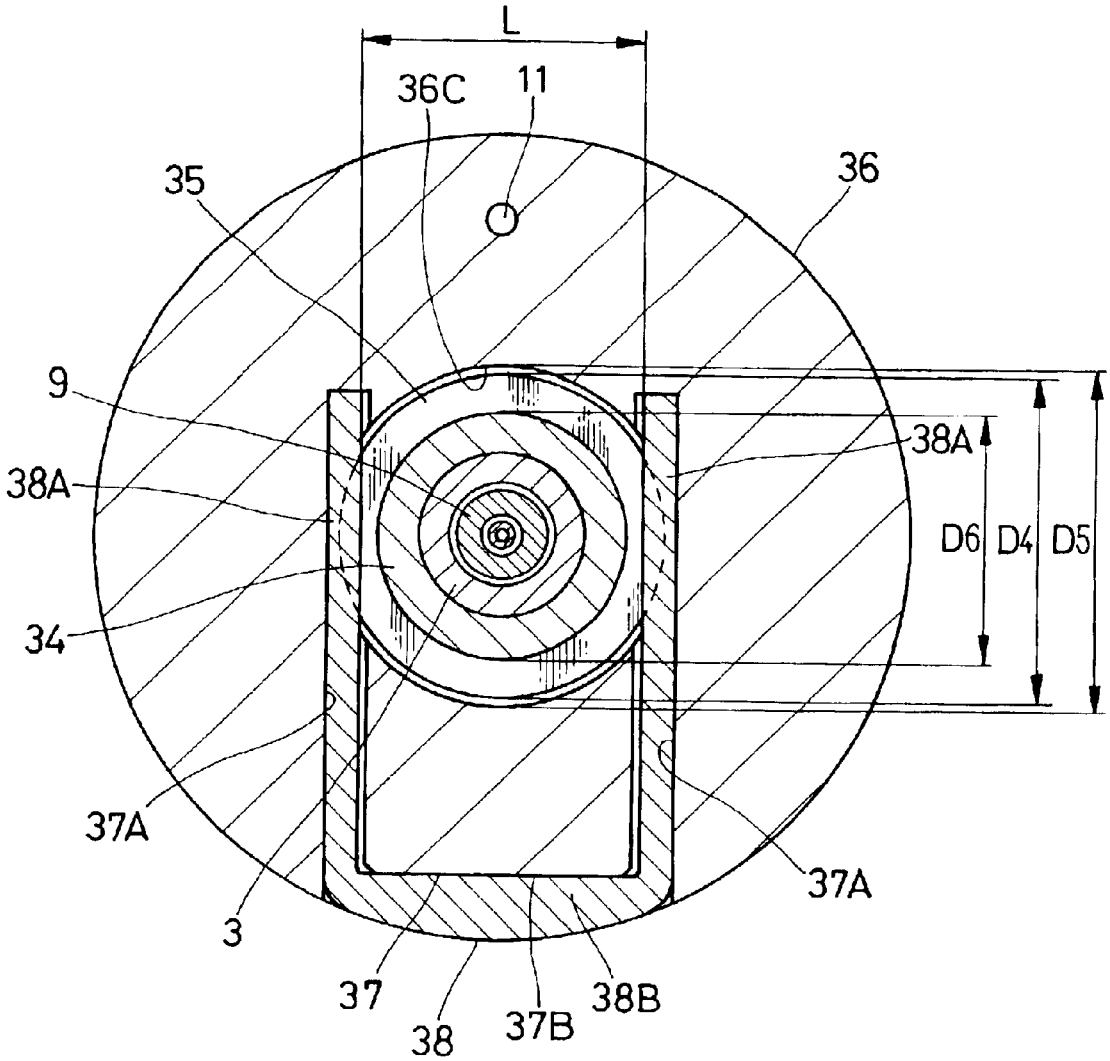
FIG. 11 is a cross-sectional view of the rotary atomizing head type coating machine, taken in the direction of arrows XI—XI in FIG. 10.

Now, turning to FIGS. 10 and 11, there is shown a third embodiment of the present invention. This embodiment has features in that an annular outward projection is formed around the entire circumference of a tubular mount portion of the rotary atomizing head, and a stopper anchor hole is provided on the side of a shaping air ring in such a way as to anchor a stopper member at a position radially inward of the inner periphery of the shaping air ring. When a rotary atomizing head is loosened and its position is shifted forward relative to a rotational shaft, the annular outward projection is brought into abutting engagement with the stopper member to prevent the rotary atomizing head from falling off the machine. In the following description of the third embodiment, those component parts which are common with the foregoing first embodiment are simply designated by common reference numerals to avoid repetitions of same explanations.

Indicated at 31 is a rotary atomizing head according to the present embodiment, and at 32 a main body of the rotary atomizing head 31. Similarly to the main body 5 in the first embodiment, the main body 32 of this embodiment is constituted by a paint atomizing portion 33 with a paint spreading surface 33A and paint releasing edges 33B, and a tubular mount portion 34 with a female screw portion 34A and an annular partition wall 34B. However, the main body 32 of the rotary atomizing head according to the present embodiment is different from the main body 5 of the first embodiment in that it is formed with an annular outward projection35 on its tubular mount portion 34, as described in greater detail hereinafter.

Indicated at 35 is an annular, outward projection which is provided at the rear end of the tubular mount portion 34 of the main body 32. The annular outward projection 35 is projected radially outward from the circumferential surface of the tubular mount portion 34. In this instance, the annular outward projection 35 is arranged to have an outside diameter D4 which is larger than a distance L between leg portions 38A of a stopper member 38, which will be described hereinafter, and smaller than an inside diameter D5 of inner peripheral surface 36C of a shaping air ring 36 ($L<D4<D5$).

Designated at 36 is a shaping air ring according to the present embodiment. Similarly to the shaping air ring 10 in the first embodiment, the shaping air ring 36 is formed in a tubular shape and provided with a large number of air outlet holes 36A (shown two holes only) at its fore end and at intervals in the circumferential direction as shown in FIGS. 10 and 11. Further, the shaping air ring 36 is provided with a front inner peripheral surface 36B and a rear inner peripheral surface 36C on its inner periphery. However, the shaping air ring 36 of this embodiment differs from the shaping air ring 10 of the first embodiment in that no D-shaped inward projection is provided on the rear inner peripheral surface 36C and a stopper anchor hole 37 is formed into the shaping air ring 36, as described hereinafter.

Indicated at 37 is a stopper anchor hole which is formed across the rear inner peripheral surface 36C of the shaping air ring 36, at an axially intermediate position of the rear inner peripheral surface 36C. The stopper anchor hole 37 is formed in U-shape as a whole in order to receive a stopper member 38 which will be described after. The stopper anchor hole 37 is composed of a couple of parallel leg-receiving portions 37A which are extended perpendicularly to the rotational shaft 3, and a connecting groove portion 37B which is formed into the outer periphery of the shaping air ring 36 in such a way as to connect opposing ends of the leg-receiving portions 37A.

Denoted at 38 is a stopper member which is removably set in the stopper anchor hole 37 of the shaping air ring 36. Similarly to the stopper anchor hole 37, the stopper member 38 is formed in U-shape as a whole. In this instance, as seen in FIG. 11, the stopper member 38 is constituted by a couple of leg portions 38A which are extended substantially in parallel relation with each other, and a grip portion 38B which is formed integrally with the leg portions 38A. The stopper member 38 is formed of a resilient material, and the leg portions 38A are slightly diverged toward the fore free ends thereof.

The stopper member 38 is set in the stopper anchor hole 37 of the shaping air ring 36 by flexing the fore free ends of the leg portions 38A slightly toward each other and inserting them into the leg-receiving portions 37A of the stopper anchor hole 37 until the grip portion 38B fits in the connecting groove portion 37B. At this time, the leg portions 38A are pressed against inner surfaces of the leg-receiving portions 37A of the stopper anchor hole 37 by resilient force of the leg portions 38A themselves, and therefore are anchored securely in the stopper anchor hole 37 by the resilient pressing force (frictional force).

In this instance, when the leg portions 38A are set in the leg-receiving portions 37A of the stopper anchor hole 37, they are projected radially inward of the rear inner peripheral surface 36C of the shaping air ring 36 to form inward projections. In this state, the inwardly projected leg portions 38A are spaced from each other by a distance L which is larger than the outside diameter D6 of the tubular mount portion 34 of the rotary atomizing head 32 but smaller than the outside diameter D4 of the annular outward projection 35 (D6<L<D4).

As described above, the outside diameter D4 of the annular outward projection 35, the inside diameter D5 of the rear inner peripheral surface 36C of the shaping air ring 36, the outside diameter D6 of the tubular mount portion 34 of the rotary atomizing head 32, and the distance L between the inwardly projected leg portions 38A of the stopper member 38 are in the following dimensional relations (2).

$$D6<L<D4<D5 \quad (2)$$

According to the present embodiment with the arrangement as describe above, the stopper member 38 is extracted from the stopper anchor hole 37 before mounting the rotary atomizing head 31 on the rotational shaft 3. Once the stopper member 38 is removed, the rotary atomizing head 31 can be easily mounted on the rotational shaft 3. After mounting the rotary atomizing head 31 in position on the rotational shaft 3, the stopper member 38 is fitted in the stopper anchor hole 37. In case the rotary atomizing head 31 is loosened and its position is shifted in a forward direction, the annular outward projection 35 is abutted against the leg portions 38A of the stopper member 38 to prevent the rotary atomizing head 31 from falling off the rotational shaft 3.

Thus, according to the present embodiment, the rotary atomizing head 31 is provided with the annular outward projection 35 around its tubular mount portion. In this case, irrespective of rotational position, the annular outward projections 35 can be brought into abutting engagement with the leg portions 38A of the stopper member 38 to prevent fall-off of the rotary atomizing head 31.

Figure 12:
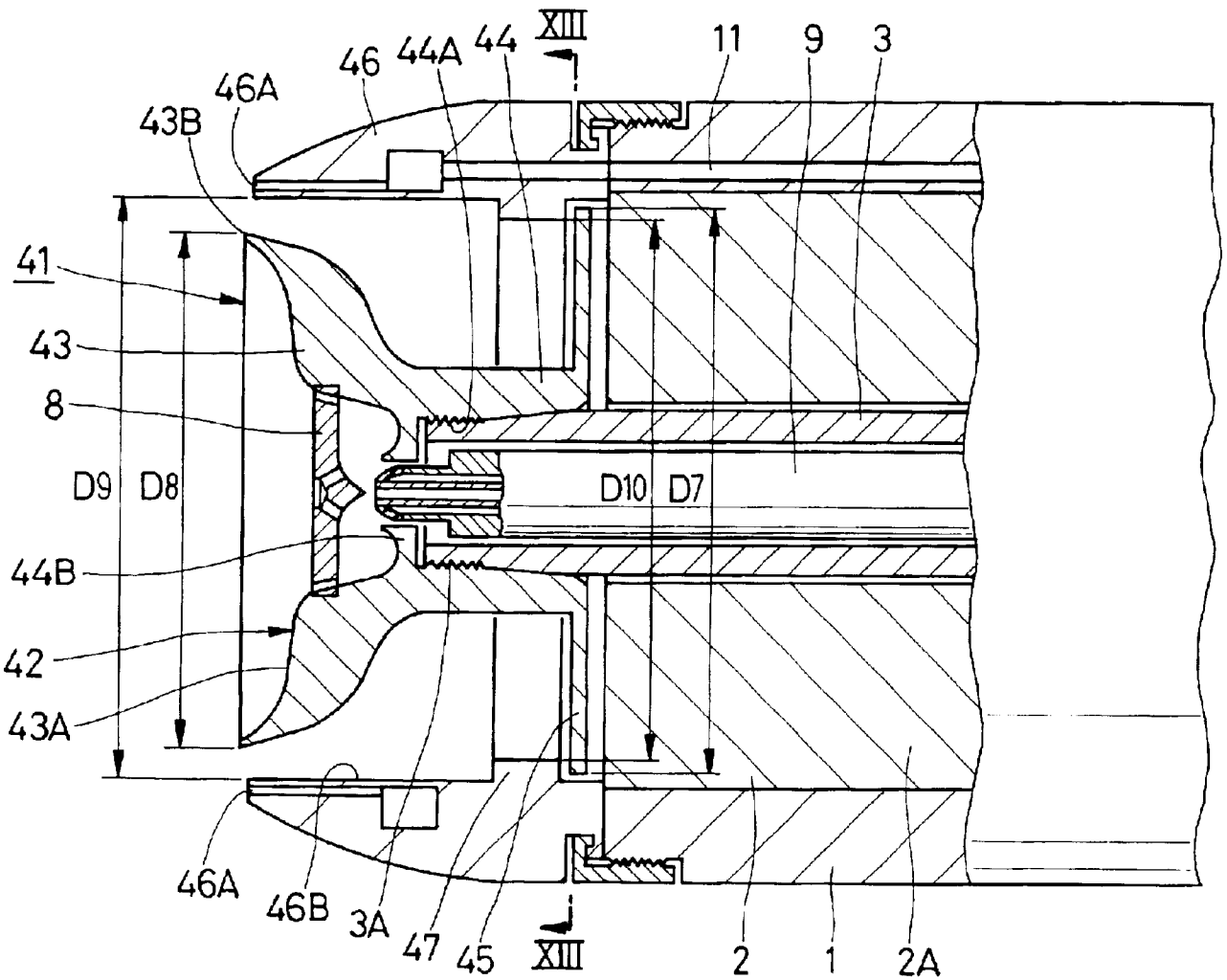
FIG. 12 is a fragmentary vertical sectional view of a rotary atomizing head type coating machine, adopted as a fourth embodiment of the present invention.
Figure 13:
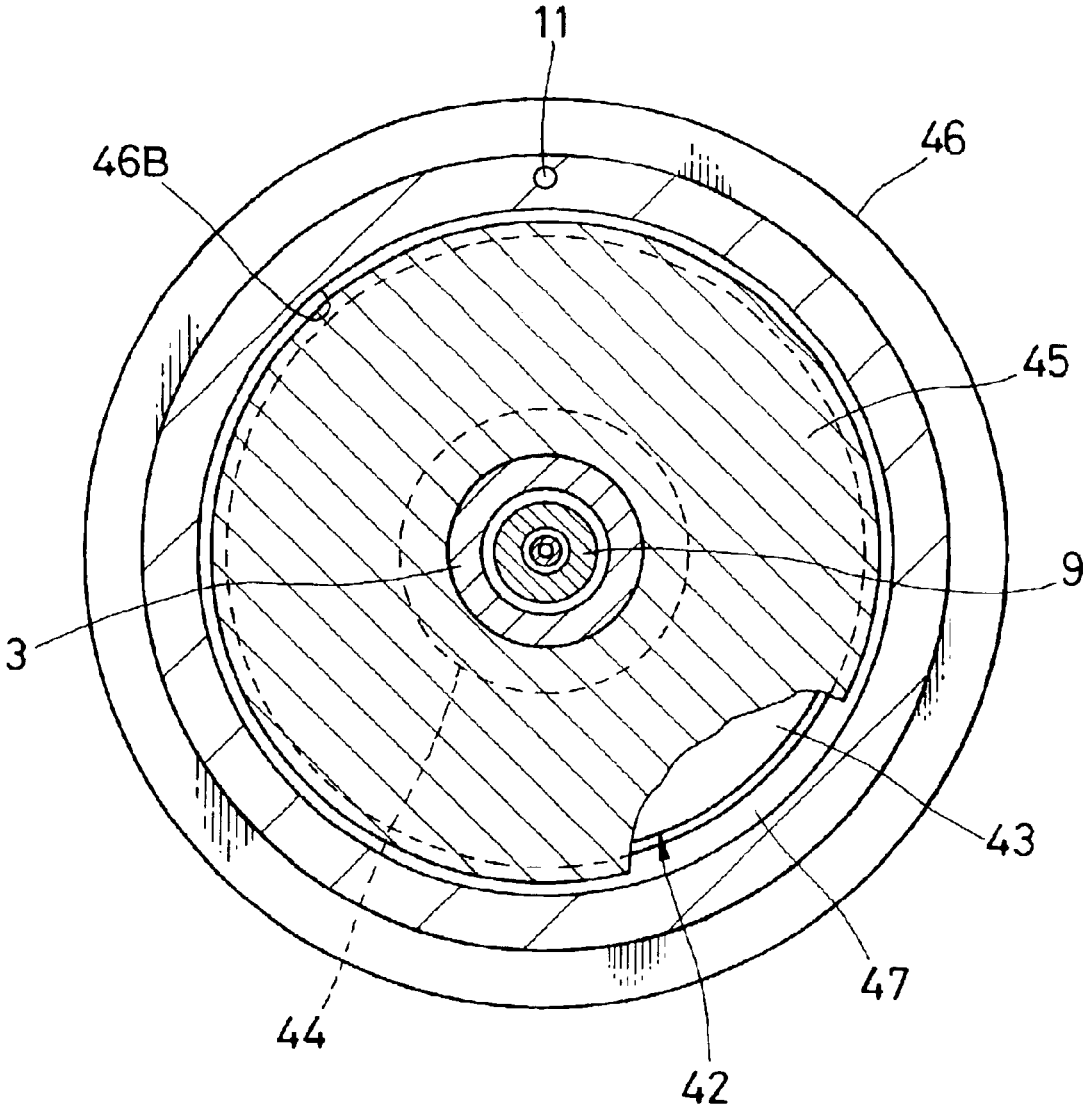
FIG. 13 is a cross-sectional view of the rotary atomizing head type coating machine, taken in the direction of arrows XIII—XIII in FIG. 12.

Now, referring to FIGS. 12 and 13, there is shown a fourth embodiment of the present invention. This embodiment has features in that an annular outward projection is formed around the entire circumference of a tubular mount portion of the rotary atomizing head, and an inward projection is formed with an inside diameter which is larger than an outside diameter of a paint atomizing portion of the rotary atomizing head. In the following description of the fourth embodiment, those component parts which are common with the foregoing first embodiment are simply designated by common reference numerals to avoid repetitions of same explanations.

Indicated at 41 is a rotary atomizing head according to the present embodiment, and at 42 is a main body of the rotary atomizing head 41. Substantially in the same manner as the main body 5 in the first embodiment, the main body 42 is constituted by a paint atomizing portion 43 with a paint spreading surface 43A and paint releasing edges 43B, and a tubular mount portion 44 with a female screw portion 44A and an annular partition wall 44B. However, the main body 42 of this embodiment differs from the main body 5 in the first embodiment in that an annular outward projection 45 is formed around the entire circumference of the tubular mount portion 44 as described in greater detail hereinafter.

Indicated at 45 is an annular outward projection which is formed at the rear end of the tubular mount portion 44 of the main body 42. As seen in FIG. 13, the annular outward projection 45 is formed either around the entire circumference of the tubular mount portion 44 or at intervals in the circumferential direction of the latter. In this instance, the annular outward projection 45 is arranged to have an outside diameter D7 which is larger than a maximum outside diameter D8 at the front end of the paint atomizing portion 43, but smaller than an inside diameter D9 of an inner peripheral surface 46B of a shaping air ring 46, which will be described hereinafter (D8<D7<D9).

Denoted at 46 is a shaping air ring according to the present invention, which is removably attached to a front end portion of the machine cover 1 in face to face with the outer peripheral side of the rotary atomizing head 41. Substantially similarly to the shaping air ring 10 in the foregoing first embodiment, the shaping air ring 46 of this embodiment is formed in a tubular shape and formed with a large number of shaping air outlet holes 46A at its front end and at intervals in the circumferential direction. However, the shaping air ring 46 according to the present embodiment differs from the shaping air ring 10 of the first embodiment in that it is formed with an inner peripheral surface 46B which has a constant diameter in the longitudinal direction, and with an annular inward projection 47 around the inner peripheral surface 46B, as described in greater detail hereinafter. In this instance, the inner peripheral surface 46B of the shaping air ring 46 has an inside diameter D9 which is larger than outside diameter D7 of the annular outward projection 45 (D7<D9).

Indicated at 47 is an annular inward projection which is provided on the inner peripheral side of the shaping air ring 46 and in the proximity of the rear end of the shaping air ring 46. The annular inward projection 47 is formed entirely around the inner peripheral surface 46B and projected therefrom in a radially inward direction. Further, when the rotary atomizing head 41 is mounted on the rotational shaft 3, the annular inward projection 47 is positioned on the front side of the annular outward projection 45. In this instance, the annular inward projection 47 has an inside diameter D10 which is set at a value larger than the maximum diameter D8 at the front end of the paint atomizing portion 43, but smaller than the outside diameter D7 of the annular outward projection 45 of the rotary atomizing head 41 (D8<D10<D7).

As described above, the outside diameter D7 of the annular outward projection 45, the maximum diameter D8 at the front end of the paint atomizing portion 43, the inside diameter D9 of the inner peripheral surface 46B and the annular inward projection 47 of the shaping air ring 46 are in the following dimensional relations (3).

$$D8<D10<D7<D9 \quad (3)$$

According to the present embodiment, with the arrangements as described above, the annular inward projection 47 of the shaping air ring 46 is arranged to have the inside diameter D10 which is larger than the maximum diameter D8 at the front end of the paint atomizing portion 43. Therefore, the shaping air ring 46 can be attached to or detached from the machine cover 1 without dismantling the rotary atomizing head 41 from the rotational shaft 3.

Accordingly, at the time of mounting the rotary atomizing head 41 on the rotational shaft 3, the rotary atomizing head 41 can be easily mounted in position on the rotational shaft 3 after removing the shaping air ring 46 from the machine cover 1. After mounting the rotary atomizing head 41 on the rotational shaft 3, the annular inward projection 47 of the shaping air ring 46 is axially passed over and along the outer periphery of the paint atomizing portion 43 of the rotary atomizing head 41 to attach the shaping air ring 46 to the machine cover 1. Thus, in the event the rotary atomizing head 41 is loosened and its position is shifted in a forward direction, the annular outward projection 45 is abutted against the annular inward projection 47 to stop the rotary atomizing head 41 at this position instead of allowing same to fall off the rotational shaft 3.

On the other hand, at the time of dismantling the rotary atomizing head 41 from the rotational shaft 3, the shaping air ring 46 is removed by passing the annular inward projection 47 over and along the outer periphery of the paint atomizing portion 43 of the rotary atomizing head 41. As soon as the shaping air ring 46 is removed, the rotary atomizing head 41 can be readily removed from the rotational shaft 3.

Thus, according to the present embodiment, the annular outward projection 45 on the rotary atomizing head 41 is brought into abutting engagement with the annular inward projection 47 of the shaping air ring 46 at any rotational position whenever the rotary atomizing head 41 is loosened relative to the rotational shaft and its position is shifted in a forward direction. In this case, fall-off of the rotary atomizing head 41 can be prevented completely. Besides, the use of an ordinary shaping air ring 46 permits to reduce the number of necessary parts as well as the production cost.

Figure 14:
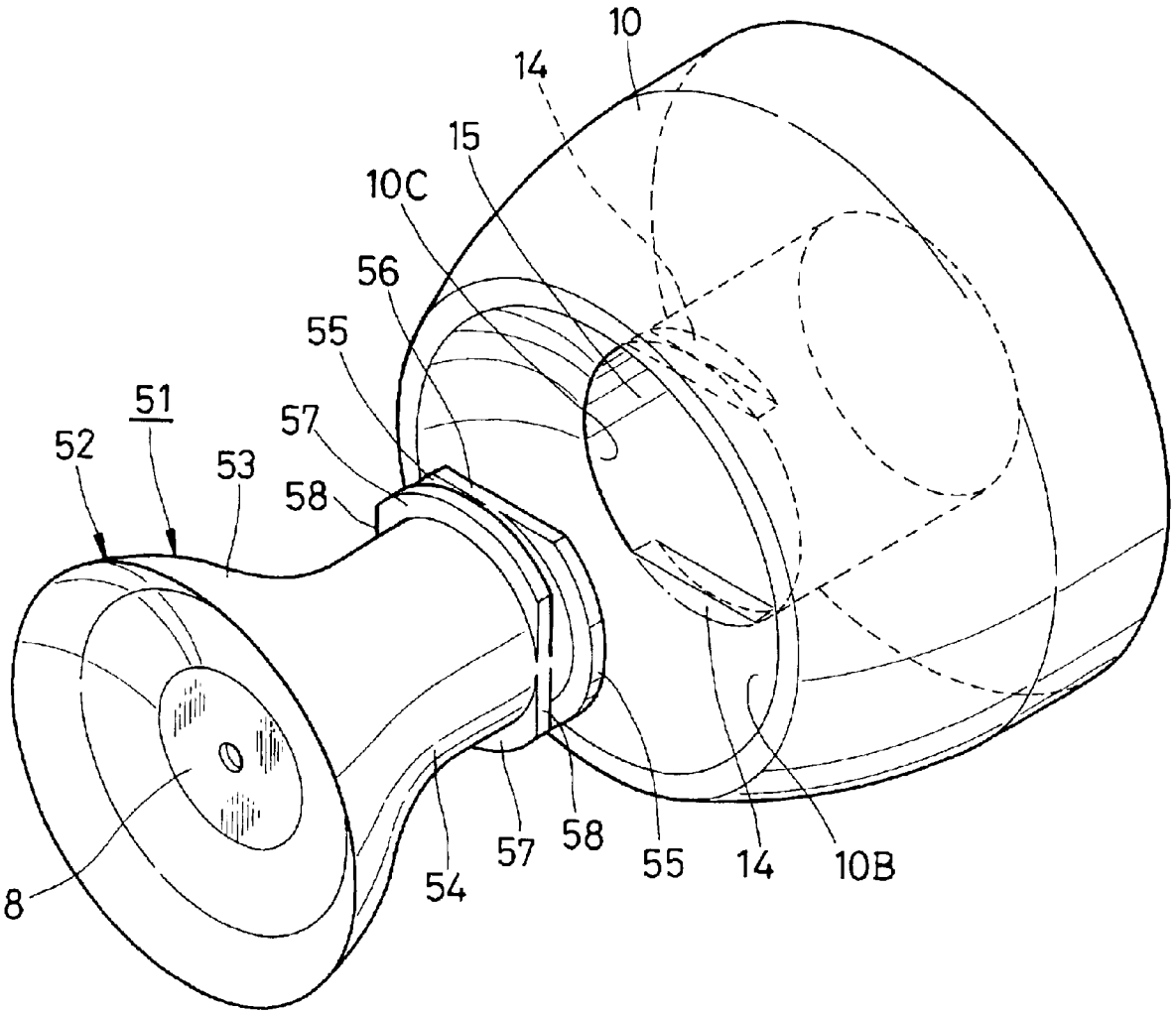
FIG. 14 is an exploded perspective view of a rotary atomizing head and a shaping air ring in a fifth embodiment of the present invention.

Now, turning to FIG. 14, there is shown a fifth embodiment of the present invention. This embodiment has features in that segmental outward projections on the side of the rotary atomizing head are provided at a plural number of positions with a phase shift in the circumferential or rotational direction. In the following description of the fifth embodiment, those component parts which are common with the foregoing first embodiment are simply designated by common reference numerals to avoid repetitions of same explanations.

Indicated at 51 is a rotary atomizing head according to the present embodiment. Substantially similarly to the main body 5 of rotary atomizing head in the first embodiment, the main body 52 of the present embodiment is constituted by a paint atomizing portion 53 which is provided on the front side to spray paint forward, and a tubular mount portion 54 which is provided on the rear side to mount the rotational shaft 3.

Denoted at 55 are first segmental outward projection which are provided on the tubular mount portion 54. First truncated side portions 56 are provided between and at the opposite sides of the first segmental outward projection 55. Further, indicated at 57 are second segmental outward projections, and the second outward projections 57 are provided at positions which are spaced from the first segmental outward projections 55 in the axial direction by a distance larger than thickness of D-shaped inward projections 14 and shifted by 90 degrees in the rotational direction. Second truncated side portions 58 are provided between and at the opposite sides of the second segmental outward projections 57.

In the case of the present embodiment with the arrangements as described above, at the time of mounting the rotary atomizing head 51, the first segmental outward projections 55 on the side of the rotary atomizing head 51 are turned into a conforming angular position with respect to the outward projection passageway 15 on the side of the shaping air ring 10, and then the rotary atomizing head 51 is moved straightforward toward the rotational shaft 3 until the first segmental outward projections 55 pass through the outward projection passageway 15 between the D-shaped inward projections 14.

In the next place, the rotary atomizing head 51 is turned by 90 degrees to bring the second outward projections 57 into a conforming angular position relative to the outward projection passageway 15. In this state, the second outward projection 57 are moved straightforward until they pass between the D-shaped inward projections 14, and the rotary atomizing head 51 is mounted on the rotational shaft 3. The rotary atomizing head 4 can be dismantled from the rotational shaft 3 by inversely following the above-described mounting steps.

According to the present embodiment, the rotary atomizing head 51 is axially passed through the D-shaped inward projections 14 on the side of the shaping air ring 10 at two different axial positions or in two stages, i.e., a first stage of passing the first segmental outward projections 55 and a second stage of passing the second segmental outward projections 57 which are in a different phase position from the first segmental outward projections 55. Thus, fall-off of the rotary atomizing head 51 can be prevented in a double assured manner.

Figure 15:
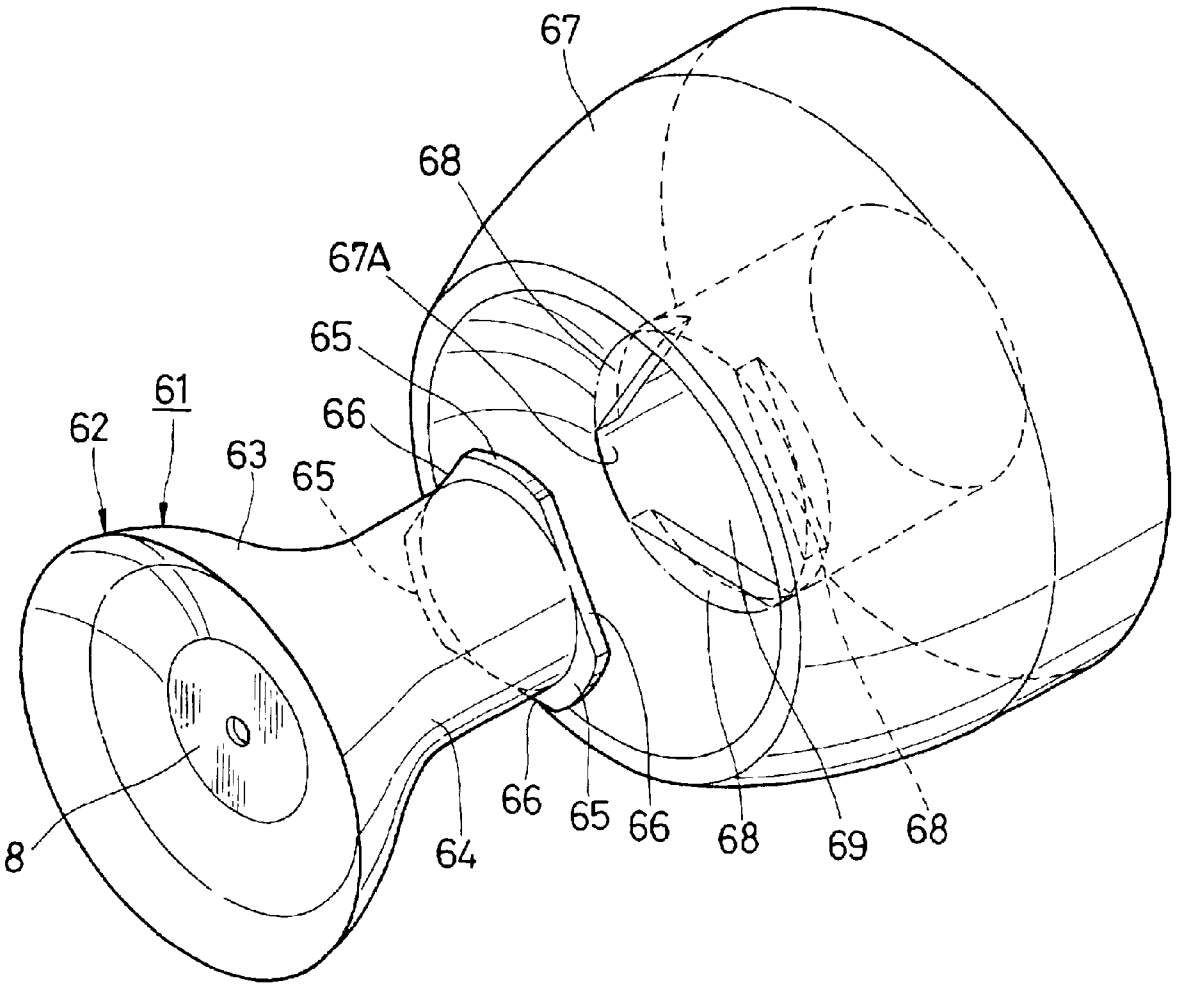
FIG. 15 is an exploded perspective view of a rotary atomizing head and a shaping air ring in a modification of the present invention.
Figure 16:
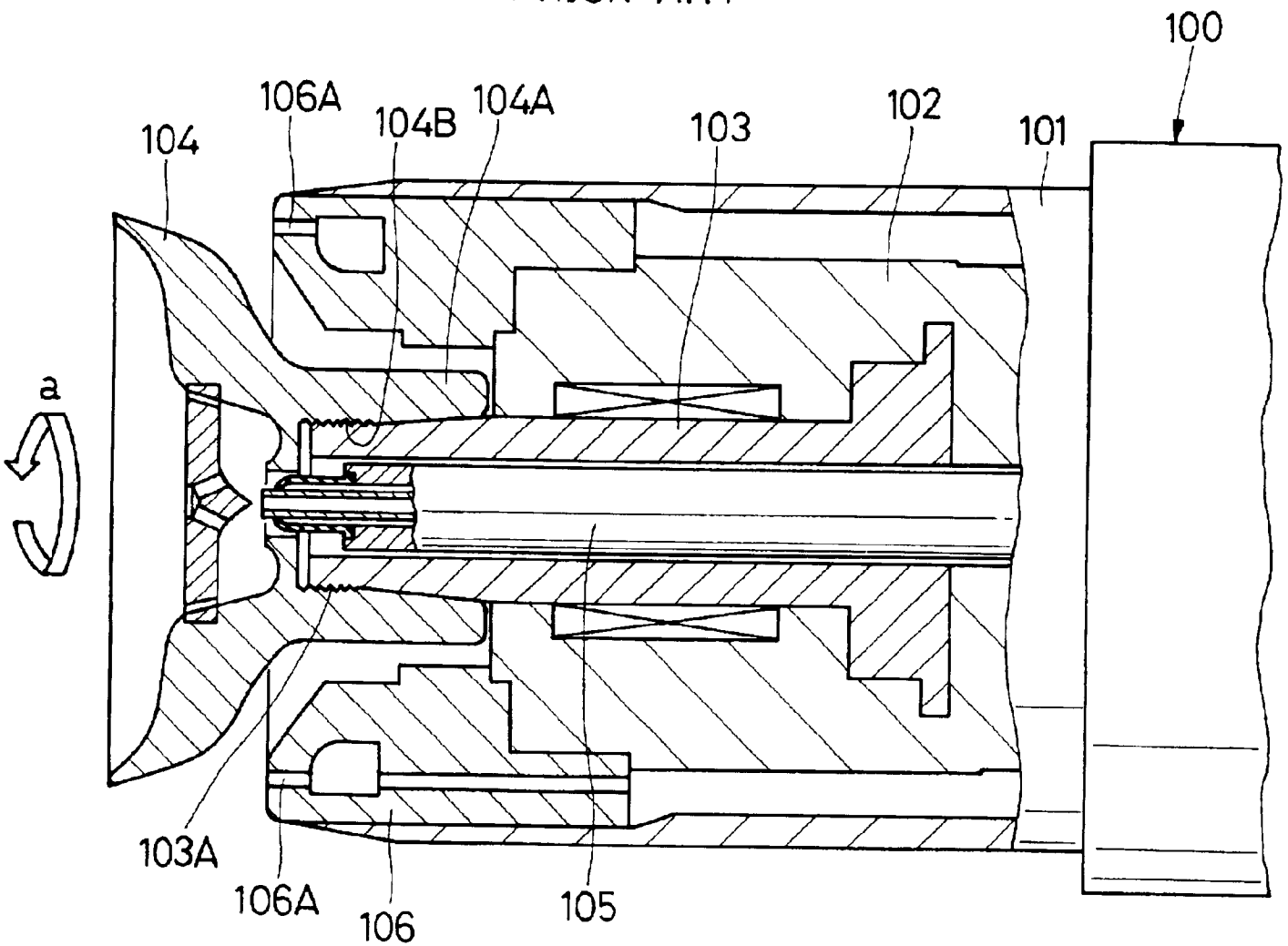
Fig. 16 PRIOR ART
FIG. 16 is a fragmentary vertical sectional view of a prior art rotary atomizing head type coating machine.
Figure 17:
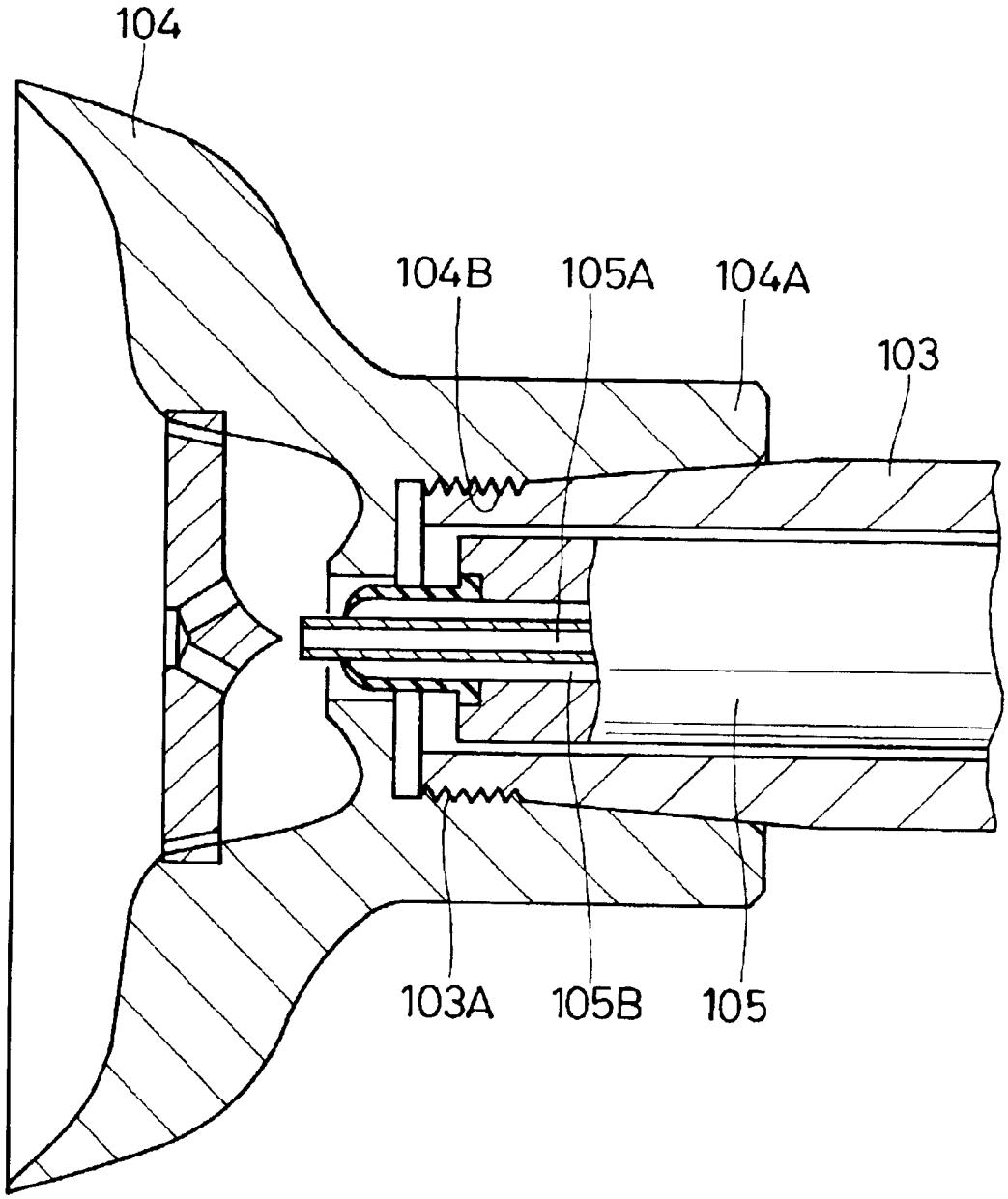
Fig. 17 PRIOR ART
FIG. 17 is an enlarged vertical sectional view of the rotational shaft and rotary atomizing head shown in FIG. 16.

In the foregoing first embodiment, the segmental outward projections 12 are formed integrally with the tubular mount portion 7 of the rotary atomizing head 5, while D-shaped inward projections 14 are provided on the inner periphery of the shaping air ring 10. These segmental outward projections 12 as well as the D-shaped inward projections 14 are provided in symmetrical positions relative to each other. However, the present invention is limited to the particular arrangements shown. For example, it is possible to make arrangements like a rotary atomizing head 61 which is exemplified as a modification in FIG. 15.

More specifically, in this case, the rotary atomizing head 61 is constituted by a main body 62 with a paint atomizing portion 63 and a tubular mount portion 64. In this case, provided at the rear end of the tubular mount portion 64 are three outward projections 65 which located at three angular positions intervals in the rotational direction alternately with three truncated side portions 66. On the other hand, correspondingly to the three outward projections 65 and the truncated side portions 66, three inward projections 68 are provided on the inner peripheral surface 67A of a shaping air ring 67 at three angular positions in such a way as to provide an outward projection passageway 69 of a generally triangular shape which permits passage of the outward projections 65 only when the latter are in a conforming angular position. In this case, however, the number of outward projections, truncated side portions and inward projections may be one or four or more, and this modification can be similarly applied to the foregoing second and fifth embodiments.

Further, in the foregoing third embodiment, the stopper member 38 is provided with a couple of leg portions 38A to form inward projections across the inner periphery of the shaping air ring. However, in this regard, the present invention is not limited to the particular arrangements shown. For example, it is possible to employ a stopper member with one and single leg portion.

Further, in the foregoing first embodiment, the rotary atomizing head 4 is detachably mounted on the rotational shaft 3 by threading the female screw portion 7A of the main body 5 of the rotary atomizing head 4 onto the male screw portion 3A of the rotational shaft 3. However, in this regard, the present invention is not limited to the particular arrangements shown. For instance, the rotary atomizing head 4 may be mounted on the rotational shaft 3 by the use of set screws. Otherwise, the rotary atomizing head 4 may be fitted on the rotational shaft 3 by the use of a resilient member like an O-ring as used in Japanese Patent Laid-Open No. H11-28391 referred to hereinbefore as prior art. These alternative arrangements can be similarly applied to the above-described second, third, fourth and fifth embodiments and modification.

On the other hand, in the foregoing fourth embodiment, the annular inward projection 47 is shown as being located on the inner peripheral surface 46B of the shaping air ring 46 at a position in the proximity to an rear end of the latter. However, in this regard, the present invention is not limited to the particular arrangements shown. For example, the annular inward projection 47 may be formed in a greater thickness and extended as far as a front end portion of the shaping air ring 46.

Furthermore, in the foregoing fourth embodiment, the inward projection 47 is formed annularly on and around the entire inner peripheral surface 46B of the shaping air ring 46. However, in this regard, the present invention is not limited to the particular arrangements shown. For example, a plural number of inward projections, namely, two or three inward projections may be formed on the inner peripheral surface 46B at angular intervals in the circumferential or rotational direction.

Moreover, in the foregoing embodiments of the invention, the air motor 2 is employed as a rotational drive source. However, needless to say, there may be employed other rotational drive source like an electric motor in place of the air motor.

What is claimed is:

1. A rotary atomizing head type coating machine, including a high speed rotational drive source, a rotational shaft rotatably supported at a base end thereof by said rotational drive source and having a fore end portion projected on the front side of said rotational drive source, a rotary atomizing head having on the front side thereof a paint atomizing portion for atomizing supplied paint into finely divided particles and on the rear side a tubular mount portion to be mounted on said projected fore end portion of said rotational shaft, and a shaping air spurting means having an inner peripheral side thereof located in such a way as to circumvent an outer periphery of said rotary atomizing head and adapted to spurt shaping air toward paint particles sprayed by said rotary atomizing head, characterized in that said rotary atomizing head type coating machine comprises:

an outward projection provided on and projected radially outward from a circumferential surface of said tubular mount portion of said rotary atomizing head; and an inward projection provided on and projected radially inward from an inner peripheral surface of said shaping air spurting means and adapted to be brought into abutting engagement with said outward projection when said rotary atomizing head is loosened relative to said rotational shaft to prevent said rotary atomizing head from falling off said rotational shaft.

2. A rotary atomizing head type coating machine as defined in claim 1, wherein said rotational shaft is provided with a male screw portion on said fore end portion thereof while said rotary atomizing head is provided with a female screw portion within said tubular mount portion for threaded engagement with said male screw portion, and said outward and inward projections are adapted to be brought into abutting engagement with each other when position of said rotary atomizing head is shifted in a forward direction relative to said rotational shaft as a result of loosening of a threaded joint of said male and female screw portions.

3. A rotary atomizing head type coating machine as defined in claim 1, wherein said outward projection is positioned axially on the rear side of said inward projection when said rotary atomizing head is mounted in position on said fore end portion of said rotational shaft.

4. A rotary atomizing head type coating machine as defined in claim 1, wherein said shaping air spurting means is provided with a fore inner peripheral surface portion for accommodating said paint atomizing portion and a rear inner peripheral surface portion for accommodating said tubular mount portion of said rotary atomizing head, and said inward projection is provided in a boundary inner peripheral surface between said fore and rear inner peripheral surface portions.

5. A rotary atomizing head type coating machine as defined in claim 1, wherein said outward projection is provided at a plural number of positions on the circumference of said tubular mount portion of said rotary atomizing head at intervals in rotational direction, and said inward projection is provided at a plural number of positions on the inner periphery of said shaping air ring at intervals in rotational direction correspondingly to said outward projection in such a way as to define therebetween an outward projection passageway which permits passage of said outward projections only when the latter are in a conforming angular position.

6. A rotary atomizing head type coating machine as defined in claim 1, wherein said outward projection is constituted by a plural number of segmental outward projections projected radially outward at radially opposite positions on the circumference of said tubular mount portion of said rotary atomizing head and having truncated side portions at opposite sides thereof, and said inward projection is constituted by a plural number of D-shaped inward projections projected radially inward at radially opposite positions on the inner periphery of said shaping air spurting means in such a way as to form therebetween an outward projection passageway which permits passage of said outward projections only when the latter are in a conforming angular position.

7. A rotary atomizing head type coating machine as defined in claim 1, wherein at least one of said outward and inward projections is provided at a plural number of positions which are shifted in axial and rotational directions.

8. A rotary atomizing head type coating machine as defined in claim 1, wherein said shaping air spurting means is detachably attached to a machine cover, said outward projection is constituted by an annular outward projection formed around the entire circumference of said tubular mount portion of said rotary atomizing head, and said inward projection on the inner peripheral surface of said shaping air spurting means is formed in an inside diameter larger than an outside diameter of said paint atomizing portion of said rotary atomizing head, said shaping air spurting means being removable from said machine before mounting or dismantling said rotary atomizing head on or from said rotational shaft.

9. A rotary atomizing head type coating machine as defined in claim 1, wherein a machine cover is provided on said machine in such a way as to circumvent an outer periphery of said rotational drive source, and said shaping air spurting means is attached to a front end portion of said machine cover.

* * * * *